US008821220B2

(12) United States Patent
King et al.

(10) Patent No.: US 8,821,220 B2
(45) Date of Patent: Sep. 2, 2014

(54) POWER TOOL WITH INTERCHANGEABLE TOOL HEAD

(71) Applicant: Black & Decker Inc., Newark, DE (US)

(72) Inventors: Wade C. King, Finksburg, MD (US); Micah A. Coleman, Baltimore, MD (US); Andrew Walker, Newton Hall (GB); Jason McRoberts, Red Lion, PA (US); Frederick R. Bean, Finksburg, MD (US); Christopher J. Murray, Philadelphia, PA (US); Frank A. DeSantis, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 14/037,462

(22) Filed: Sep. 26, 2013

(65) Prior Publication Data

US 2014/0024301 A1 Jan. 23, 2014

Related U.S. Application Data

(63) Continuation of application No. 13/804,222, filed on Mar. 14, 2013, now Pat. No. 8,613,644, which is a continuation of application No. 13/465,631, filed on May 7, 2012, now Pat. No. 8,398,457, which is a continuation of application No. 12/540,189, filed on Aug. 12, 2009, now Pat. No. 8,172,642.

(60) Provisional application No. 61/090,417, filed on Aug. 20, 2008.

(51) Int. Cl.

| | |
|---|---|
| ***B24B 23/03*** | (2006.01) |
| ***B24B 45/00*** | (2006.01) |
| ***B24B 49/00*** | (2012.01) |
| ***B24B 23/04*** | (2006.01) |
| ***B24B 41/04*** | (2006.01) |

(52) U.S. Cl.

CPC ..... *B24B 23/04* (2013.01); *B24B 45/006* (2013.01); *B24B 49/00* (2013.01); *B24B 23/03* (2013.01); *B24B 41/04* (2013.01)

USPC ..... 451/357

(58) Field of Classification Search

CPC ..... B24B 23/03

USPC ..... 451/357

See application file for complete search history.

(56) References Cited

U.S. PATENT DOCUMENTS

| | | | |
|---|---|---|---|
| 1,965,669 | A | 7/1934 | Robb |
| 2,713,271 | A | 7/1955 | Dodegge |

(Continued)

FOREIGN PATENT DOCUMENTS

| | | | |
|---|---|---|---|
| CN | 2074697 | U | 4/1991 |
| DE | 1902315 | A1 | 9/1969 |

(Continued)

*Primary Examiner* — Maurina Rachuba

(74) *Attorney, Agent, or Firm* — Harness, Dickey & Pierce, P.L.C.

(57) ABSTRACT

A power tool that includes a tool body housing, a drive system, a tool head and a connection system. The drive system is housed in the tool body housing. The tool head, which is configured to perform work on a work piece, includes a tool head housing and an input member that is driven by the drive system when the tool head is coupled to the tool body housing. The tool head can be engaged to the tool body housing in at least two pre-defined and distinct orientations. The connection system secures the tool head to the tool body housing in each of the at least two pre-defined and distinct orientations.

26 Claims, 19 Drawing Sheets

(56) References Cited

U.S. PATENT DOCUMENTS 2,893,175 A * 7/1959 Bruck ..... 451/356
2,898,616 A 8/1959 Coover
3,390,412 A 7/1968 Wolter
3,525,912 A 8/1970 Wallin
3,533,193 A * 10/1970 Dudek et al. ..... 451/356
3,566,895 A 3/1971 Goto
3,638,362 A * 2/1972 Stoll ..... 451/353
3,724,237 A 4/1973 Wood
3,747,594 A 7/1973 Bishop
3,759,336 A 9/1973 Marcovitz et al.
3,761,663 A 9/1973 Brown
3,793,776 A 2/1974 Sadow, Jr. et al.
3,841,416 A 10/1974 Pfister
3,874,125 A 4/1975 Stroezel
3,899,852 A 8/1975 Batson
3,908,139 A 9/1975 Duncan, Jr.
3,952,239 A 4/1976 Owings et al.
3,973,179 A 8/1976 Weber et al.
4,050,528 A 9/1977 Foltz et al.
4,052,824 A * 10/1977 Hutchins ..... 451/357
4,091,880 A 5/1978 Troutner et al.
4,103,511 A 8/1978 Kress et al.
4,125,339 A 11/1978 Pittinger, Sr. et al.
4,251,120 A 2/1981 Wolff
RE30,680 E 7/1981 Kress et al.
4,304,071 A 12/1981 Obrecht
4,307,325 A 12/1981 Saar
4,355,251 A 10/1982 Alessio et al.
4,410,846 A 10/1983 Gerber et al.
4,504,769 A 3/1985 Fushiya et al.
4,513,381 A 4/1985 Houser, Jr. et al.
4,625,462 A * 12/1986 Fushiya et al. ..... 451/357
4,628,459 A 12/1986 Shinohara et al.
4,728,942 A 3/1988 England
4,754,575 A 7/1988 Schneider
4,827,552 A 5/1989 Bojar et al.
4,834,596 A 5/1989 Hollifield et al.
4,835,409 A 5/1989 Bhagwat et al.
4,835,410 A 5/1989 Bhagwat et al.
4,871,629 A 10/1989 Bunyea
4,962,681 A 10/1990 Yang
4,995,148 A 2/1991 Bonomi et al.
5,018,314 A 5/1991 Fushiya et al.
5,018,411 A 5/1991 La Padura
5,033,552 A 7/1991 Hu
5,128,783 A 7/1992 Abileah et al.
5,149,230 A 9/1992 Nett
5,157,873 A 10/1992 Rudolf et al.
5,241,053 A 8/1993 Fujisawa et al.
5,296,768 A 3/1994 Burger et al.
5,374,088 A 12/1994 Moretti et al.
5,386,667 A 2/1995 Hausslein et al.
5,392,568 A 2/1995 Howard, Jr. et al.
5,398,454 A 3/1995 Berner
5,398,457 A 3/1995 Updegrave et al.
5,421,053 A 6/1995 Chodak
5,441,450 A 8/1995 Fein et al.
5,490,683 A 2/1996 Mickel et al.
5,563,482 A 10/1996 Shaw et al.
5,580,302 A 12/1996 Howard, Jr. et al.
5,679,066 A 10/1997 Butz et al.
5,709,595 A 1/1998 Bergner et al.
5,715,156 A 2/1998 Yilmaz et al.
5,771,516 A 6/1998 Huang
5,839,949 A 11/1998 Martin et al.
5,885,146 A * 3/1999 Cockburn ..... 451/357
5,941,891 A 8/1999 Walen
5,988,025 A 11/1999 Sasaki et al.
6,004,194 A * 12/1999 Hild et al. ..... 451/357
6,039,126 A 3/2000 Hsieh
6,062,575 A 5/2000 Mickel et al.
6,062,960 A * 5/2000 Kai et al. ..... 451/357
6,104,162 A 8/2000 Sainsbury et al.
6,126,370 A 10/2000 Wheeler et al.
6,132,300 A 10/2000 Martin
6,153,838 A 11/2000 Wadge
6,159,084 A 12/2000 Tiede
6,170,579 B1 1/2001 Wadge
6,176,322 B1 1/2001 Wadge
6,179,696 B1 1/2001 Duffy
6,206,107 B1 3/2001 Wadge
6,224,303 B1 5/2001 Wheeler et al.
6,237,698 B1 5/2001 Carrier et al.
6,243,276 B1 6/2001 Neumann
6,244,933 B1 6/2001 Morkvenas
6,263,980 B1 7/2001 Wadge
6,270,087 B1 8/2001 Mickel et al.
6,286,609 B1 9/2001 Carrier et al.
6,286,611 B1 9/2001 Bone
6,296,065 B1 10/2001 Carrier
6,306,024 B1 * 10/2001 Kai et al. ..... 451/357
6,343,901 B2 2/2002 Wheeler et al.
6,460,626 B2 10/2002 Carrier
6,488,710 B2 12/2002 Besselink
6,502,949 B1 1/2003 Horiyama et al.
6,553,642 B2 4/2003 Driessen
6,573,621 B2 6/2003 Neumann
6,601,621 B2 8/2003 Wixey et al.
6,613,089 B1 9/2003 Estes et al.
6,634,439 B2 10/2003 Driessen
6,641,467 B1 11/2003 Robson et al.
6,675,911 B2 1/2004 Driessen
6,675,912 B2 1/2004 Carrier
6,708,744 B2 3/2004 Wixey et al.
6,780,094 B2 8/2004 Walker
6,875,095 B2 * 4/2005 Walker ..... 451/357
6,886,615 B2 5/2005 Wixey et al.
6,910,694 B2 6/2005 Hartmann et al.
6,918,419 B2 7/2005 Wixey et al.
7,021,399 B2 4/2006 Driessen
7,048,617 B1 5/2006 Spiva
7,114,824 B2 10/2006 Picone
7,198,559 B2 4/2007 Walstrum et al.
7,220,174 B2 5/2007 Phillips et al.
7,235,005 B2 6/2007 Schnell et al.
7,270,591 B2 9/2007 Deshpande et al.
7,270,910 B2 9/2007 Yahnker et al.
7,371,150 B2 5/2008 Deshpande et al.
7,428,917 B2 9/2008 Wixey et al.
7,526,833 B2 5/2009 Cochran et al.
7,568,867 B2 8/2009 Bryan
7,609,025 B2 10/2009 Griffin
7,649,337 B2 1/2010 Uehlein-Proctor et al.
7,653,963 B2 2/2010 Cochran et al.
7,713,110 B2 5/2010 Lampka et al.
7,719,230 B2 5/2010 Griffin
7,722,435 B2 5/2010 King
7,736,216 B2 * 6/2010 King et al. ..... 451/357
7,743,683 B2 6/2010 Dayton et al.
7,770,660 B2 8/2010 Schroeder et al.
7,815,356 B2 10/2010 Lutz et al.
7,825,615 B2 11/2010 Chen et al.
7,828,630 B2 11/2010 Robson et al.
7,913,345 B2 3/2011 Dayton et al.
7,926,141 B2 4/2011 Dayton et al.
8,172,642 B2 5/2012 King et al.
8,398,457 B2 3/2013 King et al.
2002/0148623 A1 10/2002 Pan
2003/0097178 A1 5/2003 Roberson et al.
2003/0109207 A1 6/2003 Wuensch
2003/0130742 A1 7/2003 Connelly et al.
2004/0220672 A1 11/2004 Shadduck
2005/0076972 A1 4/2005 Wixey et al.
2006/0019585 A1 1/2006 Zayat et al.
2006/0146571 A1 7/2006 Whitney
2007/0095149 A1 5/2007 Sieber et al.
2008/0311832 A1 12/2008 King
2009/0010725 A1 1/2009 Egelund
2009/0126964 A1 5/2009 Schroeder et al.
2009/0239451 A1 9/2009 Geiser et al.
2010/0146797 A1 6/2010 Dreher
2010/0288520 A1 11/2010 Dayton et al.
2010/0328929 A1 12/2010 Lutz et al.
2011/0036604 A1 2/2011 Worsnop et al.

(56) References Cited

U.S. PATENT DOCUMENTS

| | | | |
|---|---|---|---|
| 2011/0094763 | A1 | 4/2011 | Wei |
| 2011/0100661 | A1 | 5/2011 | Wei |
| 2011/0100662 | A1 | 5/2011 | Wei |
| 2011/0100663 | A1 | 5/2011 | Wu |
| 2011/0108298 | A1 | 5/2011 | Zhou |
| 2011/0108299 | A1 | 5/2011 | Wei |
| 2011/0121782 | A1 | 5/2011 | Marsh et al. |
| 2011/0272172 | A1 | 11/2011 | Lau et al. |

FOREIGN PATENT DOCUMENTS

| | | | |
|---|---|---|---|
| DE | 2748502 | A1 | 5/1979 |
| DE | 2933355 | A1 | 3/1981 |
| DE | 3142749 | A1 | 5/1982 |
| DE | 3538225 | A1 | 4/1987 |
| DE | 19617572 | A1 | 11/1997 |
| EP | 0022222 | A1 | 1/1981 |
| EP | 0033161 | A1 | 8/1981 |
| EP | 0086114 | A1 | 8/1983 |
| EP | 0542667 | A2 | 5/1993 |
| EP | 0610801 | A1 | 8/1994 |
| EP | 0906812 | A2 | 4/1999 |
| EP | 1584412 | A2 | 10/2005 |
| EP | 2338644 | A2 | 6/2011 |
| FR | 2568377 | A1 | 1/1986 |
| GB | 2073062 | A | 10/1981 |
| JP | 10286772 | A | 10/1998 |
| WO | WO-0196067 | A1 | 12/2001 |
| WO | WO-2005070624 | A1 | 8/2005 |

* cited by examiner

POWER TOOL WITH INTERCHANGEABLE TOOL HEAD

CROSS-REFERENCE TO RELATED APPLICATIONS

This application is a continuation of U.S. patent application Ser. No. 13/804,222 filed Mar. 14, 2013, which is a continuation of U.S. patent application Ser. No. 13/465,631 filed May 7, 2012 (now U.S. Pat. No. 8,398,457 issued Mar. 19, 2013), which is a continuation of U.S. patent application Ser. No. 12/540,189 filed on Aug. 12, 2009 (now U.S. Pat. No. 8,172,642 issued May 8, 2012), which claims the benefit of U.S. Provisional Application No. 61/090,417, filed on Aug. 20, 2008. The entire disclosures of the above applications are incorporated herein by reference.

INTRODUCTION

The present disclosure generally relates to a sander having multiple platens that can be selectively attached to a common sander base without the use of a hand tool.

Sanders typically have a platen to which an abrasive media, such as sandpaper, is attached. Sanders with removable, differently shaped platens (e.g., rectangular, square, round) are available to permit the user of the sander to change the platen to one with a shape that is best suited for a given sander task. Such removable platens typically are secured to the sander by way of one or more threaded fasteners (e.g., socket head cap screws). These threaded fasteners require the use of tools (e.g., Allen wrenches) to remove them from the sander to thereby decouple the platen from the sander.

Various tool-less coupling systems have been developed for coupling a platen to the rotating output member of a rotary grinder. Such coupling systems, however are relatively large and costly and do not support an abrasive media in an area where one element of the coupling system is received against the platen.

SUMMARY

This section provides a general summary of the disclosure, and is not a comprehensive disclosure of its full scope or all of its features.

A tool for moving an abrasive media can include a tool body and a drive system housed in the tool body. The drive system can include an output member. A retaining member can be disposed on the tool body. A first platen having a first attachment hub can be selectively coupled with the retaining member in an installed position. The first platen can have a first rotatable member that selectively attaches to the output member in a first mode of operation. A second platen having a second attachment hub can selectively couple with the retaining member in an installed position. The second platen can have a second rotatable member that selectively attaches to the output member in a second mode of operation.

A mode selector can be disposed on the tool body. The mode selector can have a movable member and a key. The movable member can be movable between at least a first position that corresponds to a first output member speed and a second position that corresponds to a second output member speed. The movable member can be substantially aligned with a first zone on the key that corresponds to the first platen in the first position and second zone on the key that corresponds to the second platen in the second position.

According to other features, the first rotatable member of the first platen can be mounted for an orbit having a first offset relative to the output member. The second rotatable member of the second platen can be mounted for an orbit having a second offset relative to the output member. The first and second offsets can be distinct. The first rotatable member can include a first fan having a first counterbalance disposed thereon. The second rotatable member can comprise a second fan having a second counterbalance disposed thereon. The first and second counterbalances can have distinct masses. In one example, the first platen can be an orbital platen configured for orbital sander in the installed position and the second platen can be a random orbit platen configured for random orbit sander in the installed position. The first platen can comprise a plurality of flexible columns having first ends coupled to the first platen and second ends that are selectively retained by the tool body in the installed position.

According to additional features, the retaining member can comprise a wireframe that selectively nests in respective grooves defined around each of the first and second attachment hubs respectively in the installed position. A button can be disposed on the tool body. The button can cooperate with the wireframe and be movable to a release position to spread the wireframe and release the wireframe from the respective grooves to exchange between the first and second platens. According to one example, a chamfered annular leading edge is defined on each of the first and second attachment hubs respectively. Movement of a respective first or second platen to the installed position can cause the annular leading edge to spread the wireframe until continued movement toward the installed position causes the wireframe to nest in the respective grooves.

According to still other features, the tool can include a third platen having a third attachment hub that selectively couples with the retaining member in an installed position. The third platen can have a third rotatable member that selectively attaches to the output member in a third mode of operation. The first platen can define an iron-shaped profile having a substantially flat first end and a substantially pointed second end. The first platen can comprise a dust chute arranged proximate to the substantially pointed second end. The third platen can define an iron-shaped profile having a substantially pointed first end and a substantially flat second end. The third platen can comprise a dust chute arranged proximate to the substantially flat second end. The substantially flat first end of the first platen is aligned with a forward end of the tool in the installed position and the substantially pointed first end of a third platen is aligned with a forward end of the tool in the installed position.

According to still other features, the tool can comprise a speed control switch that communicates with the mode selector. The mode selector can define a rib that cams across an input of the speed control switch upon movement of the mode selector to toggle between the first output member speed and the second output member speed.

A method according to the present teachings can include providing a tool with a tool body, a drive system and a first and second platen. The tool body can have a mode selector including a movable member and a key. The drive system can have an output member. The method further includes, moving the movable member to one of a first position or a second position. The first position can correspond to the first platen and associated with a first output member speed and the second position corresponding to the second platen and associated with a second output member speed. The method can further include, mounting one of the first or second platen to the tool body according to the selected first or second position.

According to additional features, the method can include rotating a dial causing a rib defined on the dial to cam across an input of a speed control switch and change the speed of the output member between a first and second output member speed. According to one example of the method, mounting one of the first or second platens to the tool body can include urging an attachment hub associated with a respective first or second platen into engagement with a wireframe retaining member disposed on the tool body. The method further includes, urging the attachment hub into engagement with the wireframe retaining member, such that the wireframe retaining member rides over a chamfered annular leading edge defined on the attachment hub and spreads outwardly until the wireframe retaining member nests at least partially around the selected attachment hub in a groove defined on the selected attachment hub.

In another form, the present teachings provide a power tool that includes a tool body housing, a drive system, a tool head and a connection system. The tool body housing is at least partly formed by a pair of clam shell housing members and defines a cavity. The drive system is housed in the cavity and has an output member. The tool head, which is configured to perform work on a work piece, includes a tool head housing and an input member. The input member is matingly engagable to the output member to drivingly couple the output member of the drive system to the input member of the tool head when the tool head is coupled to the tool body. The connection system has at least one recess and a retainer. The at least one recess is formed in one of the tool head housing and the tool body housing. The retainer is movably coupled to the other one of the tool head housing and the tool body housing. The retainer is received into the at least one recess to fixedly but removably couple the tool head to the tool body. The tool head can be engaged to the tool body housing in at least two pre-defined and distinct orientations and the connection system secures the tool head to the tool body housing in each of the at least two pre-defined and distinct orientations.

In yet another form, the present teachings provide a power tool that includes a tool body, a tool head and a connection system. The tool body has a tool body housing and a drive system that includes a motor and an output member driven by the motor. The tool head, which is configured to perform work on a work piece, includes a tool head housing and an input member that is engagable to the output member such that the input and output members co-rotate about a rotational axis. One of the tool body housing and the tool head housing defines a hub cavity and a plurality of rail cavities, and the other one of the tool body housing and the tool head housing defines a cylindrical hub and a plurality of rails. The cylindrical hub extends longitudinally along the rotational axis and is configured to be received into the hub cavity. The rails are disposed about the cylindrical hub and extend parallel to the rotational axis. The rails are configured to be received into the rail cavities. The input member is matingly engaged to the output member to drivingly couple the drive system to the tool head when the cylindrical hub is received into the hub cavity and the rails are received into the rail cavities. The connection system has at least one recess and a retainer. The at least one recess is formed in one of the tool head housing and the tool body housing. The retainer is movably coupled to the other one of the tool head housing and the tool body housing. The retainer is received into the at least one recess to fixedly but removably couple the tool head to the tool body.

In a further form, the present teachings provide a power tool that includes a tool body, a tool head and a connection system. The tool body has a tool body housing and a drive system. The tool body housing defines a cavity and has a first handle with a portion that is configured to be gripped by a hand of a user of the power tool. The drive system includes a motor and an output member that is driven by the motor and rotatable about a rotational axis. The first handle has a first longitudinal axis that is aligned to a predetermined angle relative to the rotational axis. The predetermined angle is sized so that the longitudinal axis is closer to being parallel to the rotational axis than being perpendicular to the rotational axis. The tool head, which is configured to perform work on a work piece, includes a tool head housing and an input member. One of the tool body and the tool housing defines a mount, and the other one of the tool body and the tool housing defines a mating mount with a mount aperture that receives the mount. The input member is matingly engagable to the output member to drivingly couple the drive system to the tool head when the mount is inserted into the mount aperture. The connection system has at least one recess and a retainer. The at least one recess is formed in one of the mount and the mating mount. The retainer is movably coupled to the other one of the mount and the mating mount. The retainer is received into the at least one recess to fixedly but removably couple the tool head to the tool body.

In still another form, the present teachings provide a power tool system that includes a tool body and a tool head. The tool body has a body housing, a motor, an intermediate output member and a coupler. The body housing defines a tool head aperture and a pocket that is spaced apart from the tool head aperture. The motor is received in the body housing and drives the intermediate output member for rotation about an axis. The coupler includes a wire member and a push button. The wire member is housed in the body housing and has a pair of opposite engagement arms that extend into the tool head aperture. The push button is coupled to the wire member and is slidable between a first position and a second position. The tool head has a head housing, an intermediate input member, an output member. The head housing includes an attachment hub and a tongue that is spaced apart from and fixedly coupled to the attachment hub. The attachment hub has a generally cylindrical projection with at least one recess formed thereon. The attachment hub is received into the tool head aperture and the tongue being received in the pocket. Both the attachment hub and the tongue are non-rotatably engaged directly to the body housing. The engagement arms are received into the at least one recess to inhibit movement of the head housing along the axis in a direction away from the body housing. The intermediate input member is coupled to the intermediate output member for rotation therewith. The output member is drivingly coupled to the intermediate input member. The wire member biases the push button into the first position. Movement of the push button into the second position spreads the engagement arms apart from one another to permit the head housing to be withdrawn from the body housing along the axis.

In yet another form, the present teachings provide a power tool that includes a tool body housing, a drive system, and a tool head. The tool body housing is at least partly formed by a pair of clam shell housing members and defines a cavity. The drive system is housed in the cavity and includes a pneumatic motor and an output member that is driven by the pneumatic motor. The tool head, which is configured to perform work on a workpiece, has a tool head housing and an input member. One of the tool body and the tool housing defines a mount, and the other one of the tool body and the tool housing defines a mount aperture that receives the mount. The tool head is selectively interlocked to the tool body when the mount is inserted into the mount aperture. The input member is matingly engaged with the output member when the tool head is interlocked to the tool body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
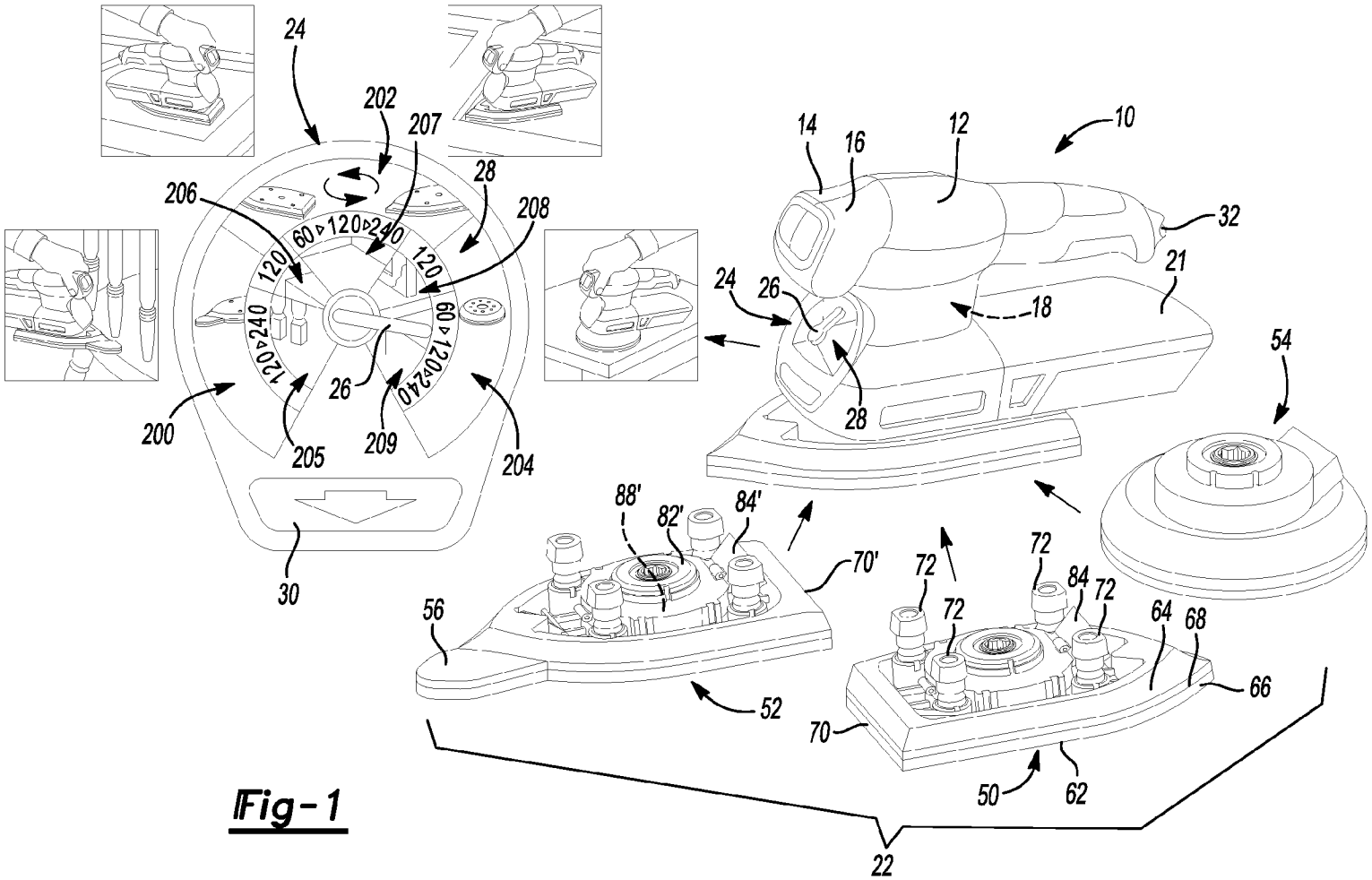
FIG. 1 is a front perspective view of an exemplary sander constructed in accordance to the present teachings and shown operatively associated with a series of sander platens that can be interchangeably secured to the sander, FIG. 1 also including an enlarged plan view of an exemplary mode selector provided on the sander.

Example embodiments will now be described more fully with reference to the accompanying drawings. Corresponding reference numerals indicate corresponding parts throughout the several views of the drawings.

With initial reference to FIGS. 1-5, an exemplary abrasive material removal tool is generally indicated by reference numeral 10. The abrasive material removal tool, hereinafter sander 10, can include a tool body or housing 12 having a pair of clam shell portions 14 and 16. The sander 10 can further include a drive system 18 that is housed in a cavity defined by the clam shell portions 14 and 16. The tool body 12 and the drive system 18 can be conventional in their construction and operation, and as such, need not be discussed in significant detail herein. The tool body 12 can further define a dust extraction port 20 (FIG. 4) to which dust can be extracted to a dust chamber 21. The drive system 18 can selectively couple with a plurality of platens, collectively referred at reference numeral 22 as will be described in greater detail herein.

A mode selector 24 can be arranged on a forward portion of the tool body 12. The mode selector 24 can include a movable member or dial 26 and a pictorial key 28. A base release button 30 can be provided proximate to the mode selector 24. A power cord 32 can extend from the tool body 12 to supply electrical current to the sander 10. It is appreciated that while the sander 10 is shown operatively associated with a power cord 32 for alternating current (AC) operation, the sander 10 can also be configured for operation with other power sources, such as direct current (DC) or a pneumatic input.

The sander 10 will be further described. The drive system 18 can include an electric motor 36 (FIG. 4) mounted within the tool body 12 and having an output member 38. In the exemplary configuration, the output member 38 can define a male spline 40. A fan (not shown) can be mounted on the output member 38 for rotation therewith. The fan can include a plurality of upwardly projecting blades generally arranged to direct air toward the motor 36. In this manner, the upwardly projecting fan blades can operate to generate a cooling air flow when the motor 36 is turned on to help cool the motor 36 during operation of the sander 10. A bearing 44 can radially support the output member 38.

With specific reference now to FIGS. 1-7, the exemplary platens 22 will be described in greater detail. According to the present teachings, each of the plurality of platens 22 can be releasably connected to the tool body 12 without the use of a hand tool (such as a screwdriver, Allen wrench, etc.). The exemplary platens 22 can include a finishing sander platen 50, a detail sander platen 52, and a random orbit sander platen 54. The detail sander platen 52 can include a releasable finger attachment 56 for detail sander. As will be described, the finishing sander platen 50 and detail sander platen 52 are configured for orbital motion while the random orbit sander platen 54 is configured for random orbit motion. U.S. Pat. Nos. 6,132,300 and 5,885,146 provide examples of abrading tools that provide orbital and random orbit motion. These patents are hereby incorporated by reference as is fully set forth in detail herein.

The finishing sander platen 50 can define a substantially flat bottom surface 62, a curved upper surface 64, and a peripheral edge with a point 66 that provides the finishing sander platen 50 with an iron-shape. The point 66 can be used for sander corners or other areas. In one example, an abrasive sheet (not shown) can be applied to the flat bottom surface 62 by way of a hook and loop fabric fastener. An underside of the abrasive sheet can have a first hook and/or loop surface, which can be attachable to a second hook and/or loop surface (not shown) provided on the flat bottom surface 62 of the finishing sander platen 50.

According to one example, a portion 68 of the finishing sander platen 50, adjacent to the point 66 of the peripheral edge, can be detachable from the remainder of the finishing sander platen 50. The detachable portion 68 can be loosened or completely detached from the finishing sander platen 50 and rotated through 180°, or even replaced, as the edges on either side of the point become worn. Further details of the detachable portion 68 can be found in commonly owned U.S. Pat. No. 5,839,949, which is hereby incorporated by reference as if fully set forth in detail herein. As can be appreciated, the finger attachment portion 56 of the detail sander platen 52 can occupy the space of an otherwise located point 66 (i.e., see finishing sander platen 50). Those skilled in the art will readily appreciate that the shape and configuration of the finishing sander platen 50 and detail sander platen 52 are substantially equivalent, the finishing sander platen 50 being configured for mounting to the tool body 12 with a flat forward end 70 facing toward the front of the sander 10, whereas the detail sander platen 52, having the finger attachment 56, can be secured to the tool body 12 having the finger attachment 56 being oriented toward the forward end of the sander 10. Those skilled in the art will also appreciate that the detail sander platen 52 can also be mounted to the sander 10 without the finger attachment 56.

Figure 2:
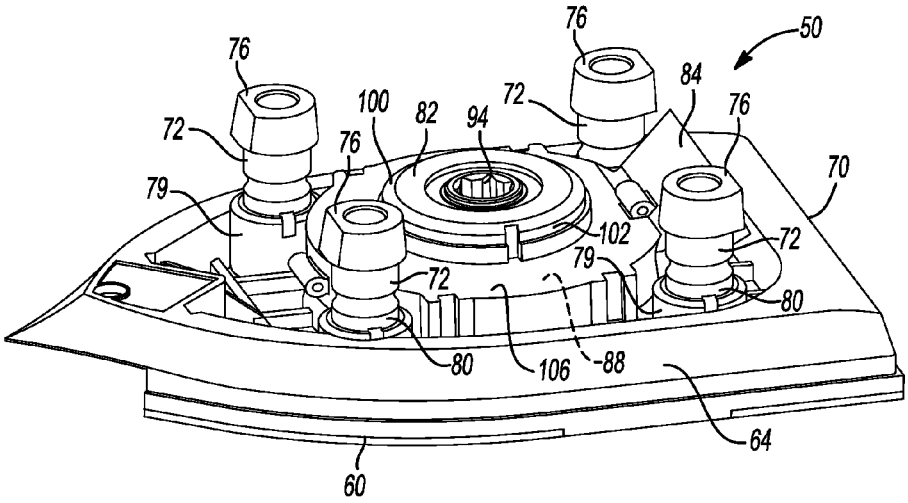
FIG. 2 is a side perspective view of an exemplary finishing sander platen.
Figure 4:
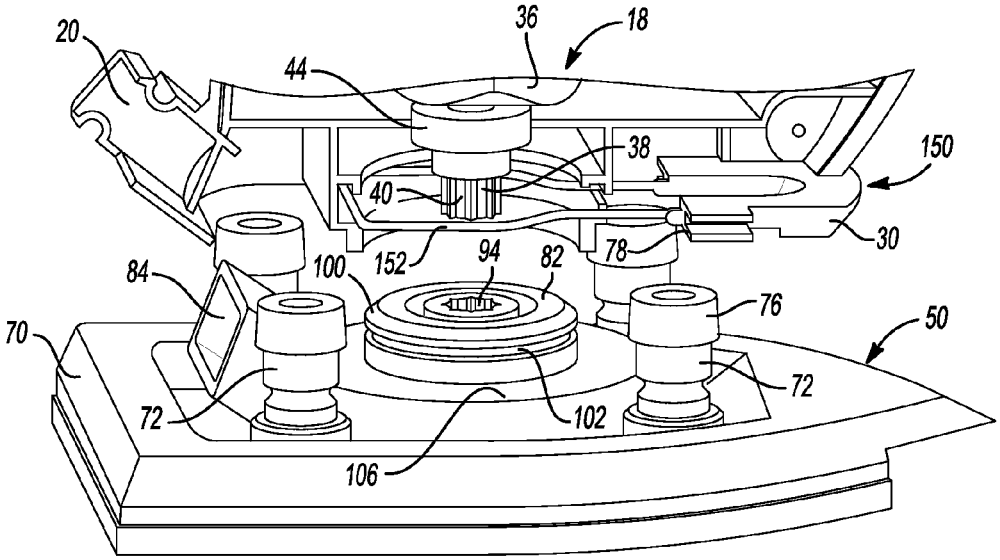
FIG. 4 is a partial cut-away view of the sander and shown with the detail sander platen aligned prior to engagement with the tool body of the sander.

With specific reference to FIGS. 2 and 4, the finishing sander platen 50 can further define a plurality of elastomeric legs 72. In the example shown, four elastomeric legs 72 are used, one pair toward the front of the sander 10 and another pair disposed toward the rear of the sander 10. First ends 76 of the elastomeric legs 72 can be selectively received by mounting hubs 78 defined in the front and rear clam shell portions 14, 16. Second ends 80 of the elastomeric legs 72 can be fixedly secured to the finishing sander platen 50 by mounting bosses 79. Other configurations may be employed for securing the elastomeric legs 72 between the tool body 12 and the finishing sander platen 50.

Figure 6:
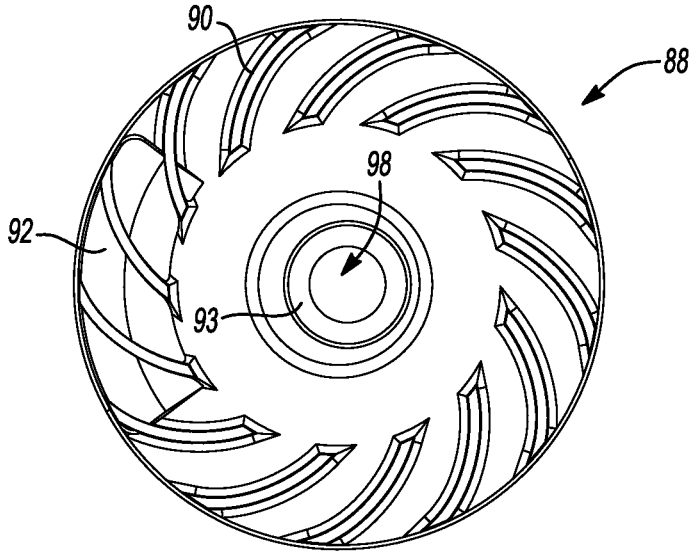
FIG. 6 is an exemplary plan view of a rotatable member having a fan and a counterweight and constructed in accordance to one example of the present teachings.

The finishing sander platen 50 can further define a centrally located attachment hub 82 and a chute 84. The attachment hub 82 can generally house a rotatable member 88 (FIG. 6). The rotatable member 88 can generally be in the form of a fan 90 having a counterweight 92. The fan 90 can be configured to direct air through the chute 84 and into the dust extraction port 20. The rotatable member 88 can define a mounting hub 93 that aligns for rotation with a female spline 94 that cooperatively receives the male spline 40 of the output member 38 in an installed position. The mounting hub 93 can be offset from a central axis 98 of the rotatable member 88. As can be appreciated, the offset can be any suitable distance to provide an orbital motion of the finishing sander platen 50 during operation. In one example, the offset can be 2 mm. Other configurations are contemplated. For example, other finishing sander platens may be provided having other offsets.

With reference again to FIGS. 2 and 4, the attachment hub 82 can define a chamfered annular leading edge 100. The attachment hub 82 can further define a groove 102 defined around a cylindrical outboard surface 104. A shroud 106 can be defined on the finishing sander platen 50. The shroud 106 can generally surround the rotatable member 88. In one example, the attachment hub 82, the chute 84 and the shroud 106 can be monolithic or integrally formed.

As can be appreciated, the detail sander platen 52 can be constructed similarly to the finishing sander platen 50. Therefore, a detailed description of the detail sander platen 52 will not be repeated. As illustrated, however, a chute 84' (FIG. 1) can be arranged proximate to its rearward end (i.e., its flat end 70') for cooperatively aligning with the dust extraction port 20 provided in the tool body 12. An attachment hub 82' can house a rotatable member 88' (FIG. 1).

Figure 3:
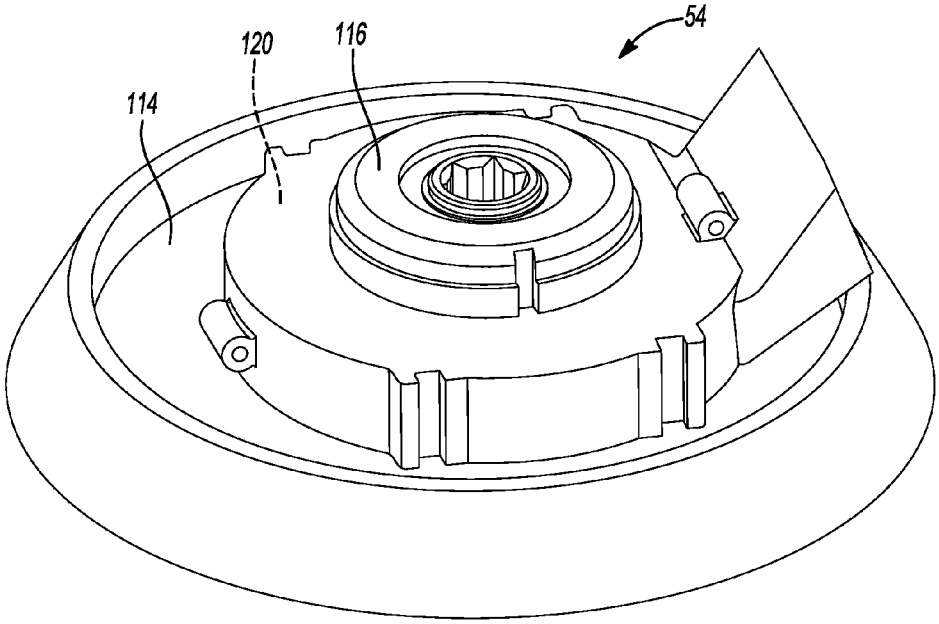
FIG. 3 is a side perspective view of an exemplary random orbit sander platen.
Figure 7:
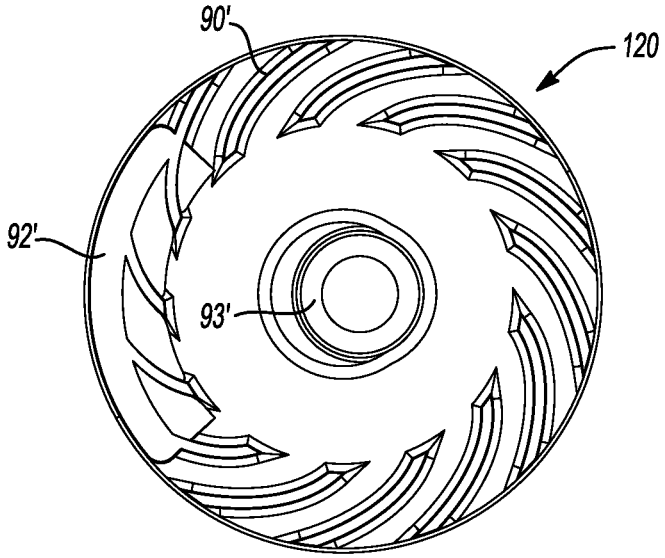
FIG. 7 is a plan view of another rotatable member including a fan and a counterweight constructed in accordance to additional features of the present disclosure.

With specific attention now to FIGS. 3 and 7, the random orbit sander platen 54 can generally define a circular platen body 114 having an attachment hub 116. Those skilled in the art will recognize that the random orbit sander platen 54 is not constrained outboard of the attachment hub 116 (i.e., such as with elastomeric legs) allowing a random orbit sander 54 to move in a motion during use. The attachment hub 116 can be formed generally equivalent to the attachment hub 82 described above with respect to the finishing sander platen 50. Housed within the attachment hub 116 is a rotatable member 120 (FIG. 7). The rotatable member 120 can define a similar mounting hub 93', fan 90' and counterweight 92' arrangement as described above with respect to the fan 90, counterweight 92 and mounting hub 93. The rotatable member 120, however, can define a distinct offset (e.g. the mounting hub can be offset from its central axis) as compared to the orbit sander platens 50 and 52, described above. In one example, the offset can be about 4 mm. In another example, the offset can be 2 mm and the orbit can be 4 mm. It is appreciated, however, that each of the platens 22 can define mounting hubs (i.e., 93) that have an offset relative to a central axis of the rotatable member (i.e., 88) for providing a desired offset according to a given application. It is also appreciated that each of the counterweights (i.e., 92) can be provided with a mass that is specific to a given platen (i.e., 50, 52 or 54).

Figure 8:
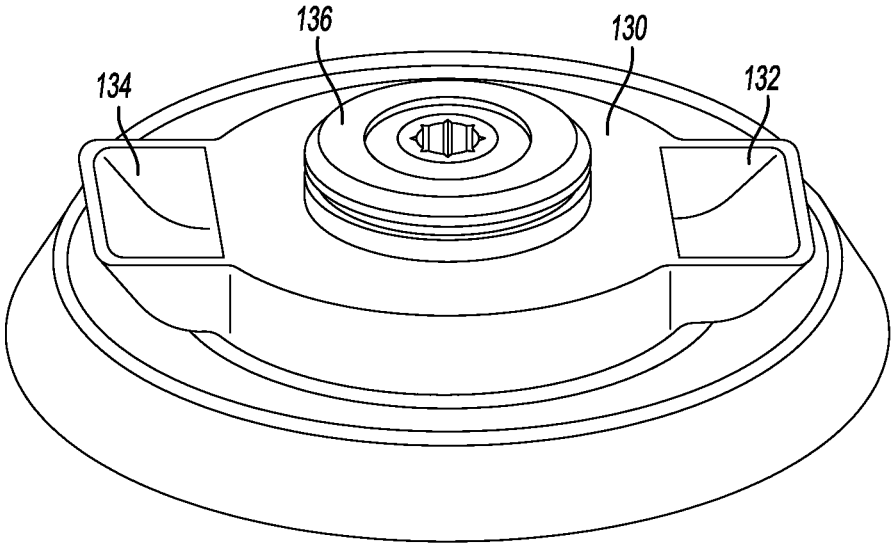
FIG. 8 is a side perspective view of an exemplary random orbit sander platen and shown with a dual-outlet shroud according to one example of the present disclosure.
Figure 9:
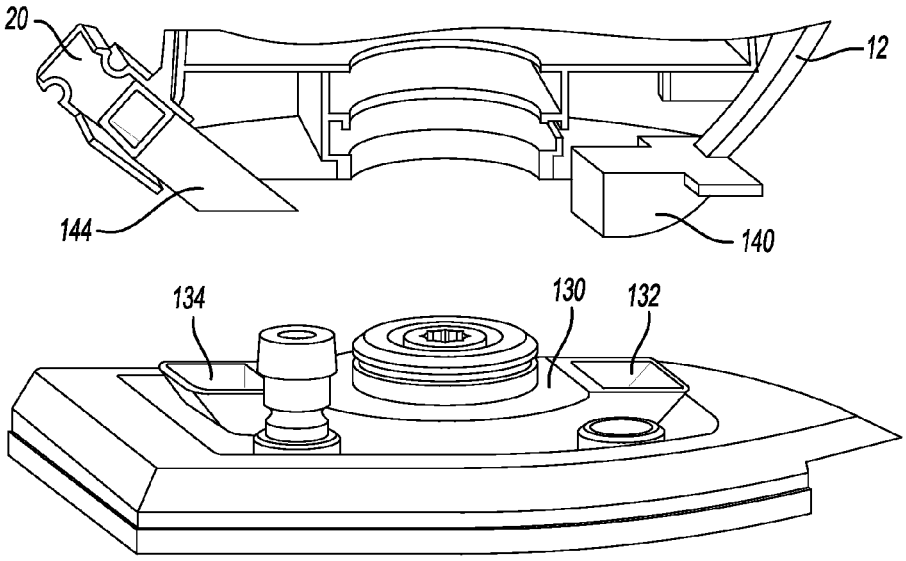
FIG. 9 is a partial cut-away view of the tool body of the sander and shown prior to engagement with a platen having the dual shroud.
Figure 10:
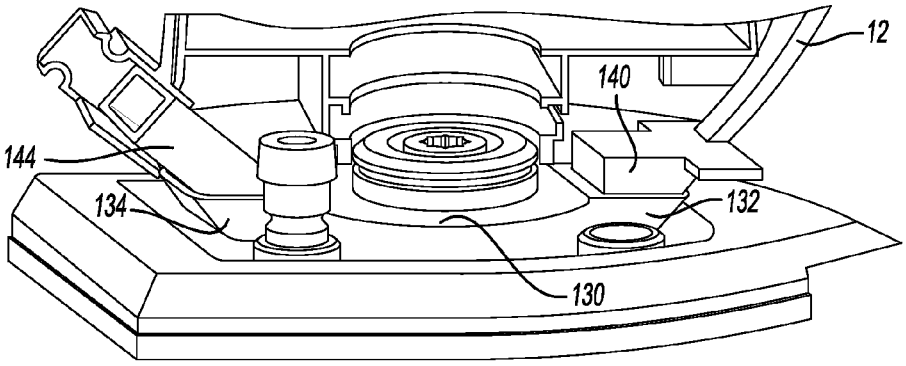
FIG. 10 is an assembled view of an exemplary sander platen having the dual-outlet shroud and connected to the tool body of the sander, wherein one of the outlets is aligned for coupling with a plug and the other outlet is aligned for communicating air through a dust extraction port formed in the tool body.

Turning now to FIGS. 8-10, a shroud 130 constructed in accordance to another example is shown. The shroud 130 includes a first chute 132 and a second chute 134 formed thereon. The shroud 130 can be integrally formed with an attachment hub 136. The attachment hub 136 can be formed equivalently to the attachment hubs 82 and 116 described above. Those skilled in the art will recognize that the shroud 130, having first and second chutes 132 and 134, can operatively align with the dust extraction port 20 in either a forward mounted position (i.e., the pointed end aligned with the front of the sander 10 for an iron-shaped platen) or a rearward mounted position (i.e., the flat end arranged toward the front of the sander 10). In one example, a plug 140 can be provided in the tool body 12 for aligning with an unused chute 132, 134. In one example, the plug 140 can be formed of a compliant material and be generally captured by one of, or both of the clam shell housings 14, 16. According to one example, a dust chute connector 144 can be interposed between the functioning chute 132 or 134 and the dust extraction port 20. It is appreciated that the shroud 130 can be adapted for use with any of the platens 22 disclosed herein. For example, the shroud 130 is shown in FIG. 8 operatively associated with a circular random orbit sander platen, whereas the shroud 130 is shown in FIGS. 9 and 10 cooperatively with an iron-shaped finishing sander platen.

Figure 5:
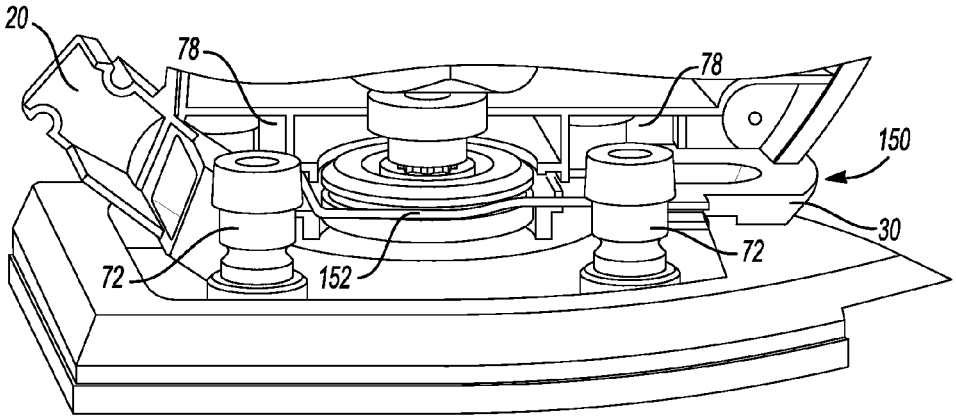
FIG. 5 is a partial cut-away view of the sander of FIG. 4 and shown with the detail sander platen selectively coupled to the tool body of the sander.

With renewed reference now to FIGS. 4 and 5, the sander 10 can include an attachment assembly 150 for releasably coupling the respective sander platens 22 to the tool body 12. The attachment assembly 150 can generally include the button 30, a retaining member or wireframe 152 and a spreader block 154. In the exemplary embodiment, the retaining member 152 is in the form of a wireframe. However, other configurations are contemplated. In general, the wireframe 152 can selectively nest with the groove (i.e., groove 102) of a respective attachment hub (i.e., attachment hub 82).

Figure 11:
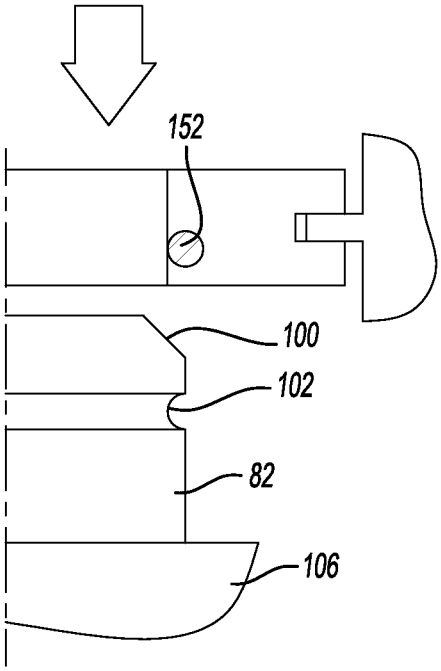
FIGS. 11-14 illustrate an exemplary assembly sequence wherein an attachment assembly selectively couples with an attachment hub provided on an exemplary sander platen.
Figure 12:
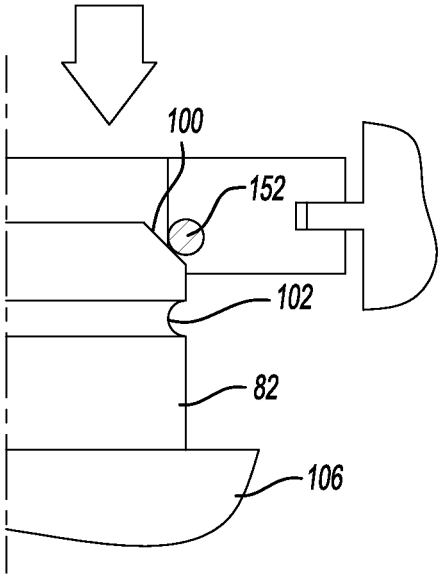
Figure 13:
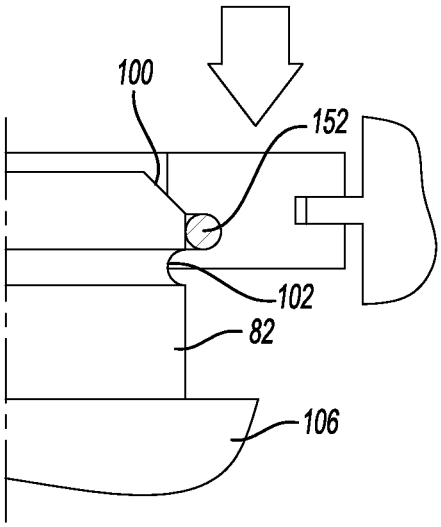
Figure 14:
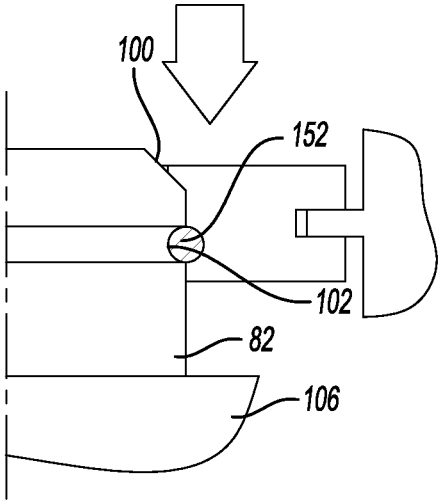
Figure 15:
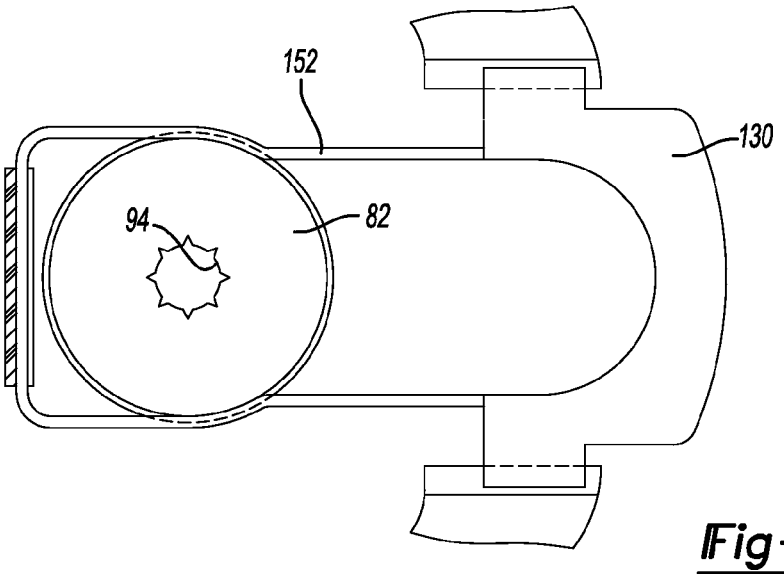
FIGS. 15 and 16 illustrate an exemplary sequence of releasing a sander platen from the tool body wherein a button of the attachment assembly is actuated causing a wireframe to spread and therefore release from engagement with a groove defined on the attachment hub.
Figure 16:
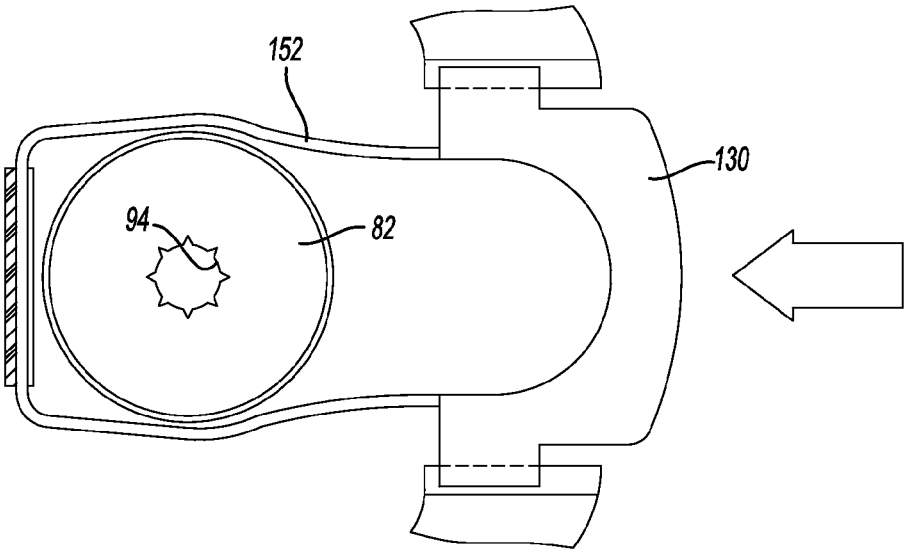
Figure 17:
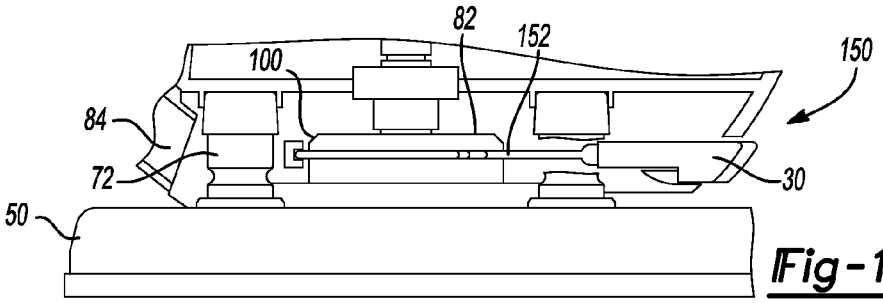
FIGS. 17-19 illustrate an exemplary sequence of releasing a sander platen from the tool body wherein the button is actuated causing release of the wireframe from the groove defined in the attachment hub.
Figure 18:
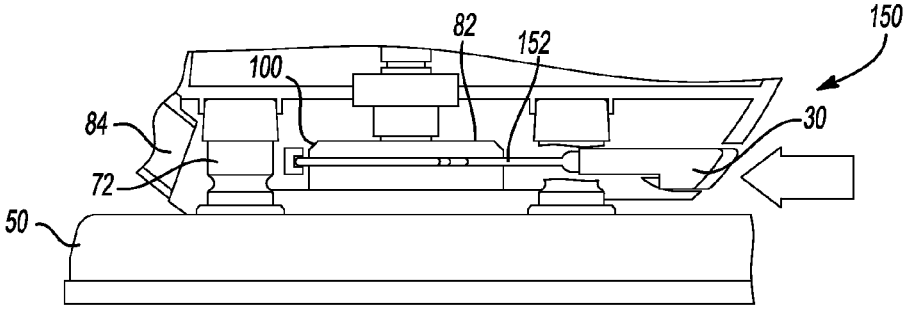
Figure 19:
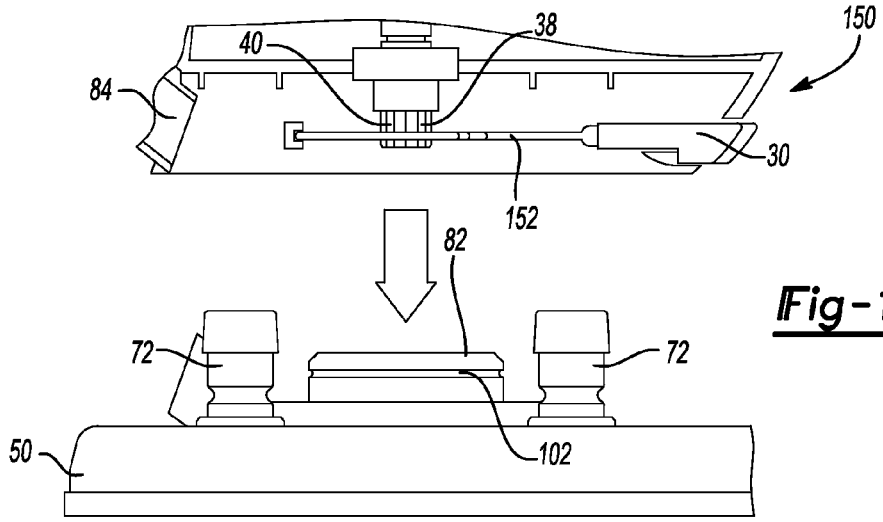
Figure 20:
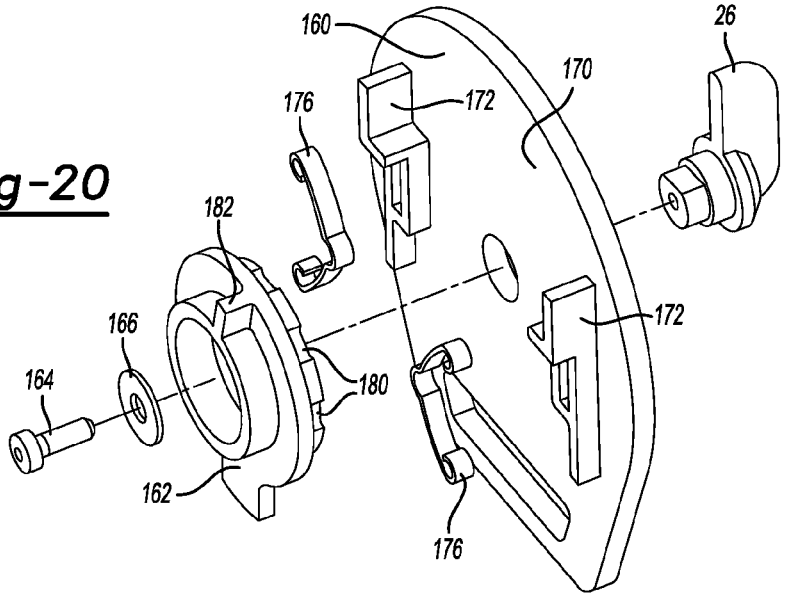
FIG. 20 is an exploded perspective view of the mode selector of FIG. 1.
Figure 21:
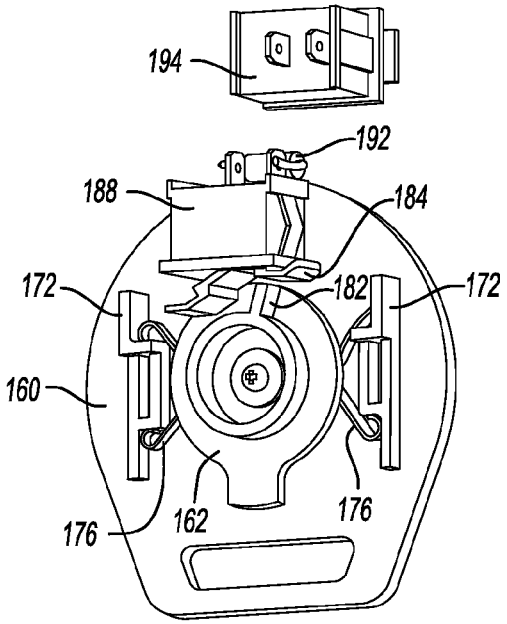
FIG. 21 is a rear perspective view of a control panel of the mode selector of FIG. 20 and shown cooperating with a speed control switch.
Figure 22:
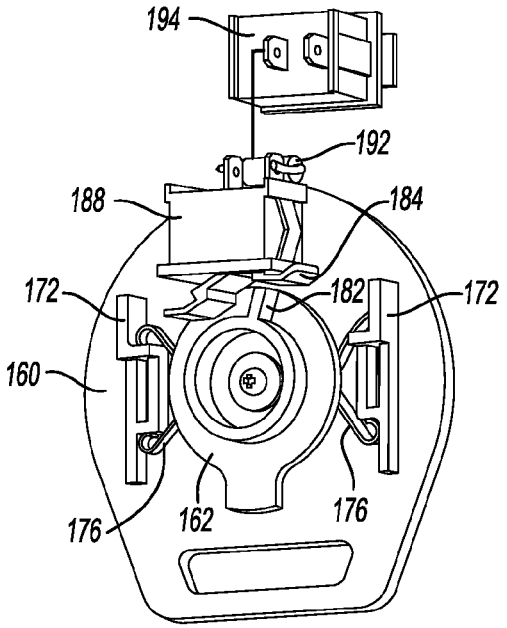
FIG. 22 is a rear perspective view of the control panel of FIG. 21 and shown with the speed control switch and electrical communication with an on/off switch.

As mentioned above, the attachment assembly 150 can selectively couple with an identified sander platen 22 without the use of a hand tool (such as a screwdriver or Allen key, etc.). An exemplary method of attaching the finishing sander platen 50 according to one example of the present teachings will now be described with reference to FIGS. 4, 5 and 11-19. It is appreciated that attaching (and removing) other platens (i.e., 52 or 54) will be carried out similarly. At the outset, a user can generally align the female spline 94 of the rotatable member 88 with the male spline 40 of the output member 38 (FIG. 4). Concurrently, a user can align the first ends 76 of the legs 72 with the respective hubs 78 defined in the tool body 12. The user can then urge the tool body 12 downwardly (and/or the finishing sander platen 50 in a direction upward) as viewed in FIG. 11. During such motion, the wireframe 152 can slidably urge over the chamfered annular leading edge 100 of the attachment hub 82 causing the wireframe 152 to generally spread outwardly until the wireframe 152 "snaps" into the groove 102 (see sequence of FIGS. 11-14). Those skilled in the art will appreciate that the wireframe 152 can have spring-like characteristics, such that in its relaxed state, the wireframe 152 can occupy a nested position within the groove 102 and therefore retain a respective sander platen 22. In one example, the wireframe 152 can be formed of a metallic material. Those skilled in the art will appreciate that the attachment assembly 150 and/or the wireframe 152 can be configured differently. During the advancement of the attachment hub 82 toward the tool body 12, the first ends 76 of the legs 72 can nest into the respective hubs 78 defined in the tool body 12.

An exemplary method of releasing the finishing sander platen 50 according to the present teachings will now be described. Again, it is appreciated that releasing other platens (i.e., 52 or 54) will be carried out similarly. A user can push the base release button 30 inwardly (i.e., in a direction leftward as viewed in FIG. 16). Movement of the base release button 30 in a direction leftward (i.e., into the tool body 12) can cause the button to slide along the wireframe 152 and therefore urge an intermediate portion of the wireframe 152 to spread radially out of engagement with the groove 102. With the wireframe 152 in a position clear from the groove 102 (FIGS. 16 and 19), a user can then pull the finishing sander platen 50 in a direction downward (i.e., in a direction along an axis defined by the female spline 94) and away from the tool body 12.

With reference now to FIGS. 1 and 20-22, the mode selector 24 will be described in greater detail. The mode selector 24 can generally define a control panel 160 that rotatably supports the movable member 26 to a backing plate 162 by way of a threaded fastener 164 and washer 166. A rear face 170 of the control panel 160 can define a pair of supports 172 that mount a pair of detent springs 176, respectively. The backing plate 162 can define a plurality of depressions 180 formed around its annular surface. As will be described, the detent springs 176 can selectively nest within an aligned pair of depressions 180 to positively locate the movable member 26 at a desired operating location. The backing plate 162 can further define a rib 182. The rib 182 can be aligned with a toggle bar 184 associated with a speed control switch 188. According to one example, the toggle bar 184 can toggle between a first and second position upon movement of the rib 182 across the toggle bar 184. As will be described, the first and second position can correspond to a first and second speed of the motor 36 (and therefore the output member 38).

An exemplary circuit associated with the mode selector 24 will be described briefly. The speed control switch 188 can include a diode 192. The speed control switch 188 can be electrically connected to an on/off switch 194 of the sander 10. In one example, when the speed control switch 188 is moved to the first or "on" position, current bypasses the diode 192 and the sander 10 runs at full speed. When the speed control switch 188 is turned to the second or "off" position, the current is forced through the diode 192 and the voltage is dropped causing the motor 36 (and, as a result, the output member 38 to rotate at a reduced speed).

With reference again to FIG. 1, the pictorial key 28 of the mode selector 24 will be described in greater detail. As shown, the pictorial key 28 can have a first outer zone 200, a second outer zone 202, and a third outer zone 204. In one example, each of the first, second and third outer zones 200, 202, and 204 can include graphical information, such as photos and/or sketches that correspond to a given sander task. As illustrated, the first outer zone 200 can include a graphic with a pictorial representation of the detail sander platen 52. The second outer zone 202 can have a graphical representation of the finishing sander platen 50. The third outer zone 204 can have a graphical representation of the random orbit sander platen 54. In one example, each of the outer zones can be color-coded with a distinct color. In addition, a picture of a turtle can be provided on the first outer zone 200 and a picture of a rabbit can be provided on the third outer zone 204. As can be appreciated, a rotational orientation of the movable member 26 pointing toward the third outer zone 204 can correspond with the first speed and with the toggle bar 184 in the first position, such that the speed control switch 188 is in the "on" position. Likewise, when the movable member 26 rotated to be pointed toward the first outer zone 200, the toggle bar 184 is toggled to the second position (via movement of the rib 182 across the toggle bar 184) corresponding to the speed control switch 188 in the "off" position. It is appreciated that additional speed settings may be provided according to the outer zones and/or the inner zones (described below). It is contemplated that a potentiometer could be implemented to control speed.

According to other examples, indicia can be arranged around the pictorial key 28 that correspond to a grit value of sand paper optimized for a given task. Additionally or alternatively, the pictorial key 28 can have a graphic (e.g. picture, sketch, photograph, etc.) that corresponds to an exemplary article for sander (i.e., a door, a table, a pedestal, etc.). The grit value and picture of the article to be sanded can be arranged as a first inner zone 205, a second inner zone 206, a third inner zone 207, a fourth inner zone 208 and a fifth inner zone 209. It can be appreciated that while the mode selector 24 has been shown and described above in connection to a movable member 26 that rotates around an axis in the form of a dial or pointer, the mode selector can take alternate forms. For example, the mode selector 24 can alternatively comprise a lever configured for linear movement or other configurations.

Figure 23:
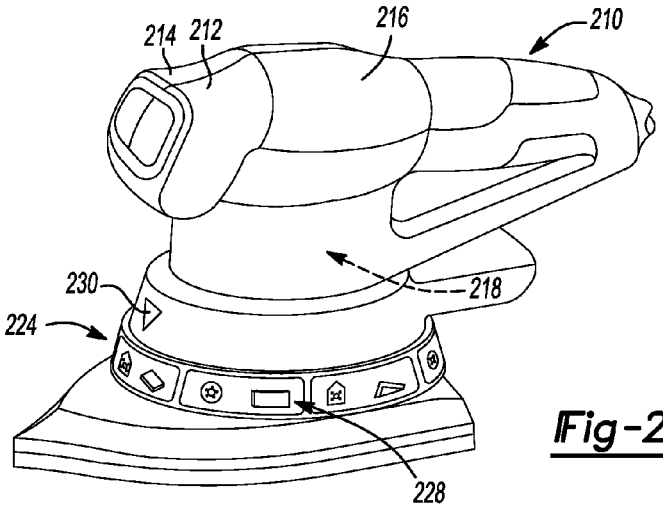
FIG. 23 is a side perspective view of a sander constructed in accordance to additional features of the present teachings.
Figure 24:
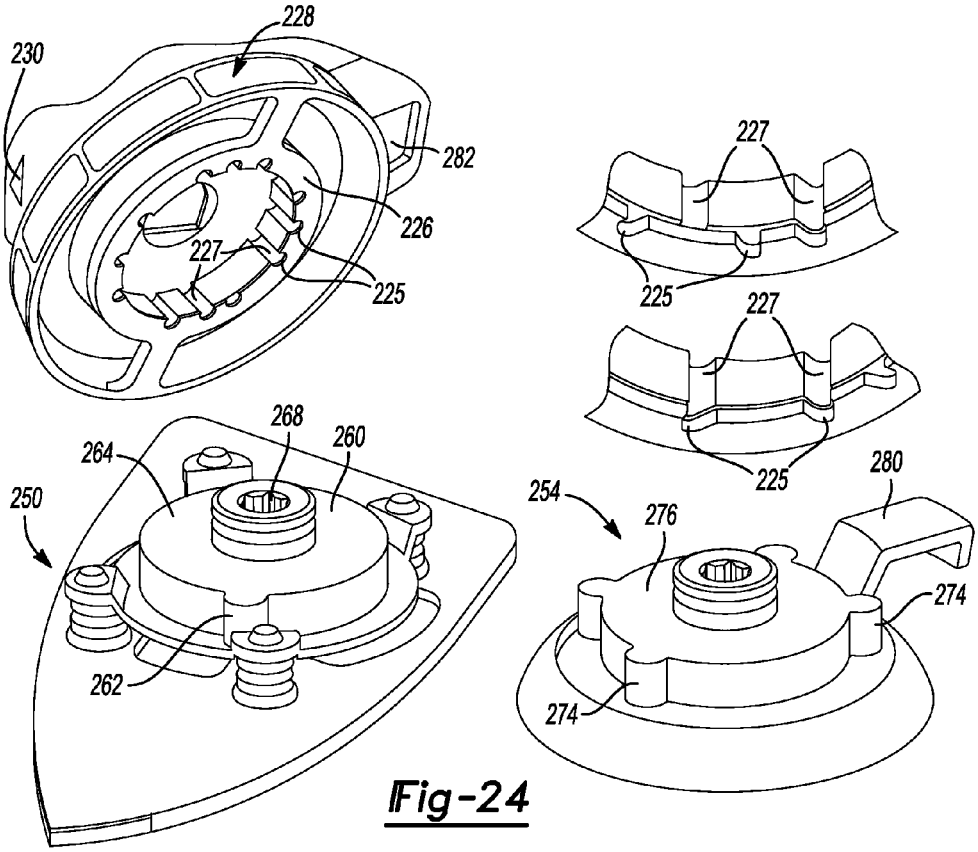
FIG. 24 is a front perspective view of a pair of exemplary sander platens that include nubs that selectively communicate with a first and second plurality of notches provided on the sander for coupling a desired platen to the tool body of the sander.

With reference now to FIGS. 23 and 24, a sander 210 constructed in accordance to another example of the present teachings is shown. Except as otherwise described, the sander 210 can comprise the features as discussed herein with respect to other sanders. The sander 210 can generally include a tool body or housing 212 having a pair of clam shell portions 214 and 216. The sander 210 can further include a drive system 218 that is housed in a cavity defined by the clam shell portions 214 and 216. The tool body 212 and the drive system 218 can be conventional in their construction and operation, and as such, need not be discussed in significant detail herein. A mode selector 224 can be rotatably coupled to the tool body 212. As with the tool 10 described above, the sander 210 can be configured for selectively mating with a plurality of platens 222. An underside of the mode selector 224 can define a first plurality of notches 225 formed around an annular ring 226. The first plurality of notches 225 can cooperatively align with a second plurality of notches 227 defined in the tool body 212. The mode selector 224 can further define a pictorial key 228 arranged therearound. The pictorial key 228 can define similar graphical representations as described above with respect to the pictorial key 28. In the mode selector 224, according to this example, however, the pictorial key 228 of the mode selector 224 is rotated to align with an arrow 230 provided on the tool body 212.

The plurality of platens 222 can define a finishing sander platen 250 and a random orbit sander platen 254. Other platens may be provided. The detail sander platen 252 can define an attachment hub 260 that includes a series of nubs 262 extending outwardly around a shroud 264 thereof. A female spline 268 can be provided on the finishing sander platen 250 and be configured for meshingly engaging a male spline 270 provided on an electric motor 272 of the drive system 218. The nubs 262 are configured for slidably aligning and inserting into corresponding first and second notches 225 and 227 defined on the ring 226 of the mode selector 224 and the tool body 212, respectively. As can be appreciated, the first plurality of notches 225 will be rotationally aligned with specific second plurality of notches 227 for accepting the correct platen 222 that corresponds with a given graphic provided on the pictorial key 228 aligning with the arrow 230.

The random orbit sander platen 254 can include nubs 274 arranged around an attachment hub 276. A tongue 280 can extend outwardly adjacent from the attachment hub 276. The tongue 280 can be configured to cooperatively nest in a pocket 282 formed on the tool body 212. As illustrated, the nubs 274 are located at a radially distinct location around the attachment of 276 as compared to the nubs 262 arranged around the attachment hub 260. As can be appreciated, once a user rotates the mode selector 224 to a location in which a graphic of the pictorial key 228 that illustrates the random orbit sander platen 254 is aligned with the arrow 230, the nubs 274 cooperatively align with predetermined notches 225 (of the ring 226 of the mode selector 224) and notches 227 (of the tool body 212). As can be appreciated, the rotational orientation of the notches 225, 227 will permit attachment with only the sander platen 222 identified in the pictorial key 228 aligned with the arrow 230. Therefore, attachment of other sander platens 222 is precluded.

It is appreciated that while the above embodiment has been described in association with "notches" and "nubs" other geometries may be provided for selectively keying specific platens to the tool body 212.

While not specifically shown, a rotatable member can be provided in the respective attachment hubs 260 and 276 that can be configured to provide a desired offset and/or counterbalance mass according to a given task. Also, while not specifically shown, the platens 222 can be selectively coupled to the sander 210, such as by way of an attachment assembly (see attachment assembly 150 described above), or other methods of attachment.

Figure 25:
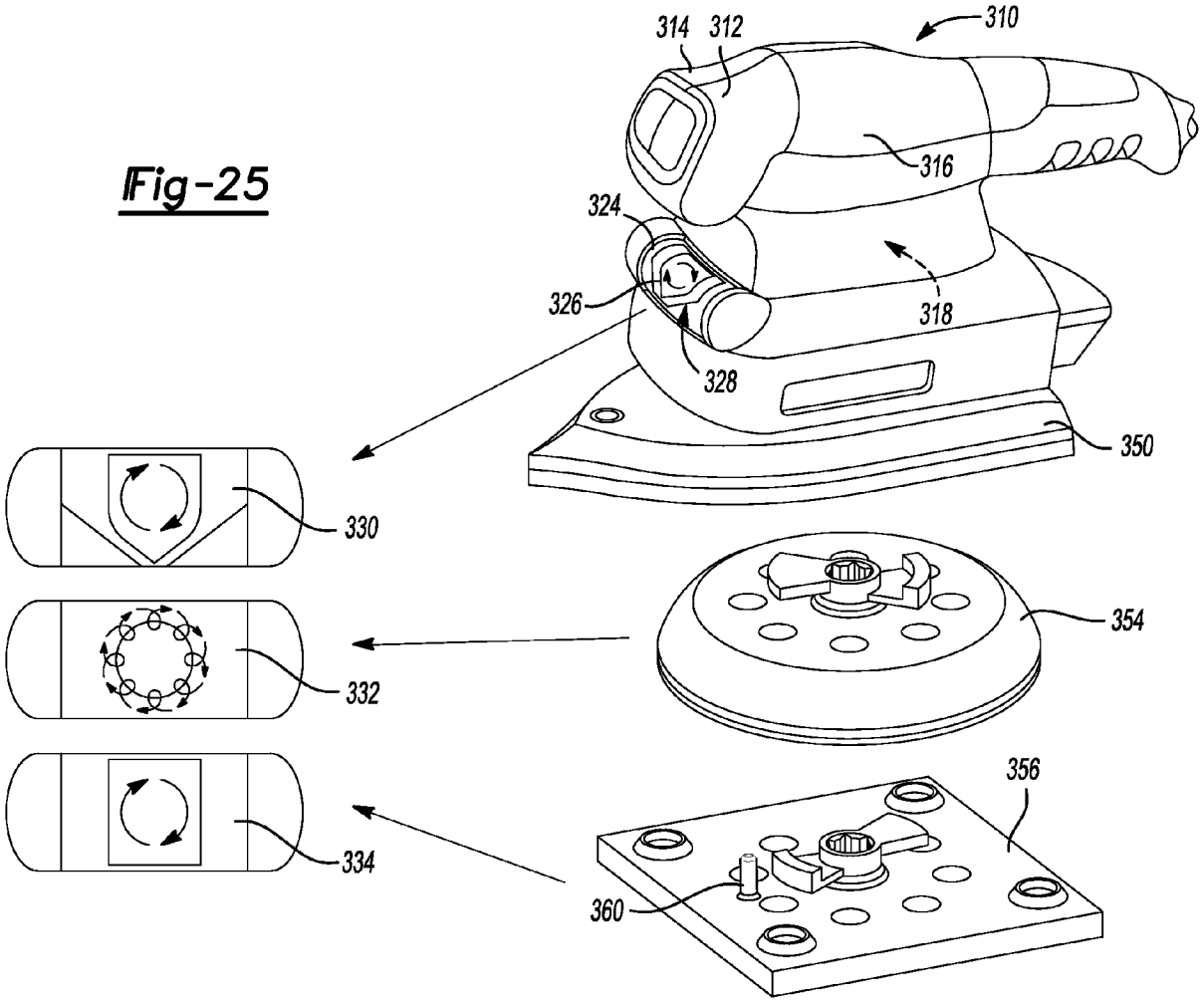
FIG. 25 is a front perspective view of a sander constructed in accordance to additional features of the present teachings and shown operatively associated with a series of exemplary sander platens.
Figure 26:
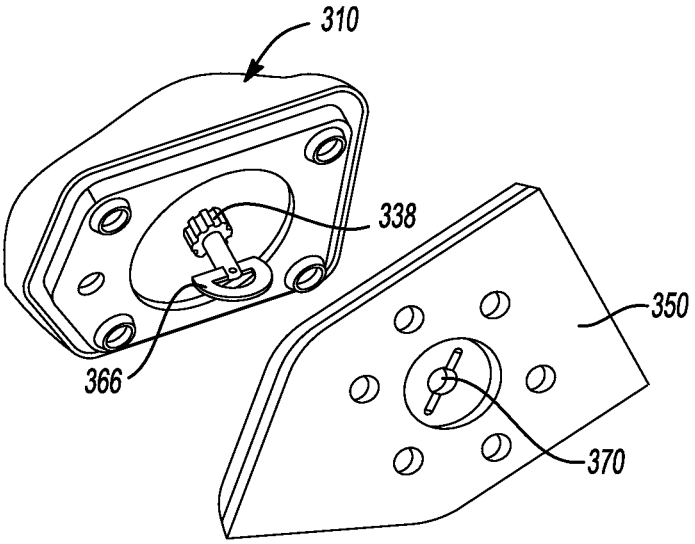
FIG. 26 is a bottom perspective view of the sander of FIG. 25 and shown with an exemplary key for selectively attaching a desired platen to the tool body.

Turning now to FIGS. 25 and 26, a sander 310 according to another example, of the present teachings is shown. Except as otherwise described, the sander 310 can comprise the features as described in herein with respect to other sanders. The sander 310 can include a tool body or housing 312 having a pair of clam shell portions 314 and 316. The sander 310 can further include a drive system 318 that is housed in a cavity defined by the clam shell portions 314 and 316. The tool body 312 and the drive system 318 can be conventional in their construction and operation, and as such, need not be discussed in significant detail herein. The drive system 318 can selectively couple with a plurality of platens, collectively referred to a reference 322. The sander 310 can include a window 324 that provides viewing access to a wheel 326. In one configuration, the wheel 326 can define a pictorial key 328. The pictorial key 328 can include a first zone 330, a second zone 332, and a third zone 334. The respective zones 330, 332 and 334 can correspond to a graphic (i.e., picture, sketch) that illustrates the shape of a given platen 322 as well as a directional path that such given platen 322 will operate in.

The platens 322 can include a finishing sander platen 350, a random orbit sander platen 354, and a square footprint detail sander platen 356. According to one example, a finger, or other structure 360, such as shown on the detail sander platen 356 can be provided for rotating the wheels 326 into a rotational position that corresponds to the zone (i.e., 330, 332, or 334) associated with the attached platen 322 being viewed through the window 324. In one example, a flip key 366 can extend from the output member 338 of the sander 310. The flip key 366 can pass through the corresponding opening 370, shown on the finishing sander platen 350 and rotated to a secured position to lock a given platen 322 relative to the tool body 312. While not specifically shown, a similar opening is defined on the other platens 354 and 356. The flip key 366 can also be provided on other sanders disclosed herein for securing other platens described herein.

Figure 27:
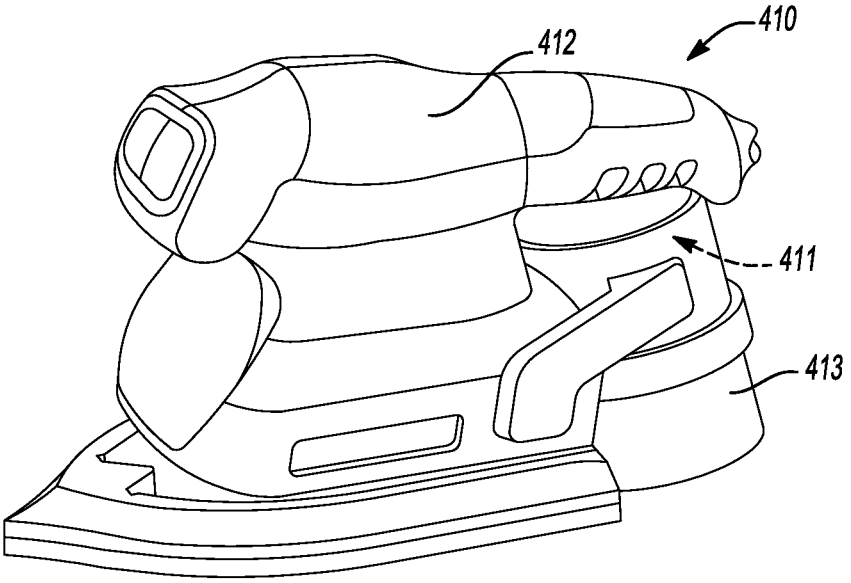
FIG. 27 is a front perspective view of a sander constructed in accordance to additional features of the present teachings and including a dust collection canister.

Turning now to FIG. 27, a sander 410 according to additional features of the present teachings is shown. Except as otherwise described, the sander 410 can comprise the features as described herein with respect to other sanders. The sander 410 can be constructed similar to the sanders 10, 210 and 310 described above and also include a dust extraction fan 411 provided in a canister 413 of the tool body 412. Because a dust extraction fan 411 is provided in a canister 413, a plurality of platens (i.e., such as 350, 354 and 356, FIG. 25) can include rotatable members tuned for each platen. As such, each rotatable member can define a counterweight mass and offset, but without a fan (i.e., the fan 90 described above in relation with the sander 10).

Figure 28:
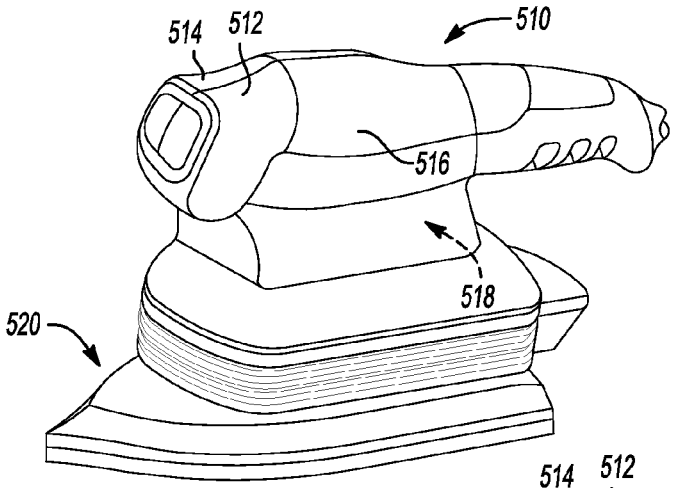
FIGS. 28-30 are front perspective views of sanders constructed in accordance to additional features of the present disclosure and including elastomeric bellows.
Figure 29:
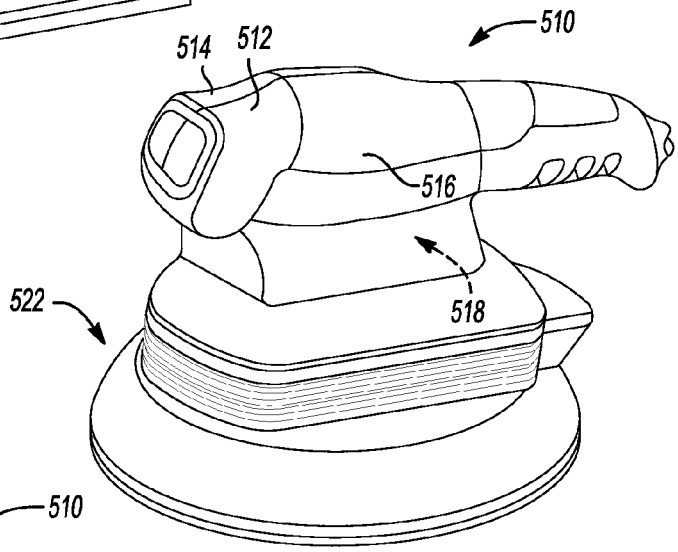
Figure 30:
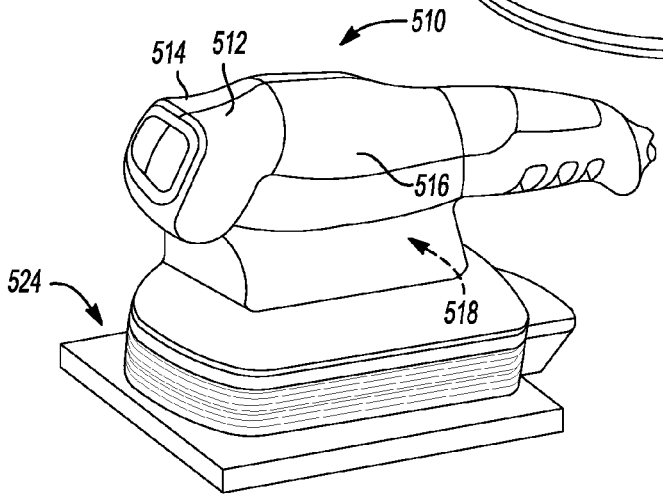
Figure 31:
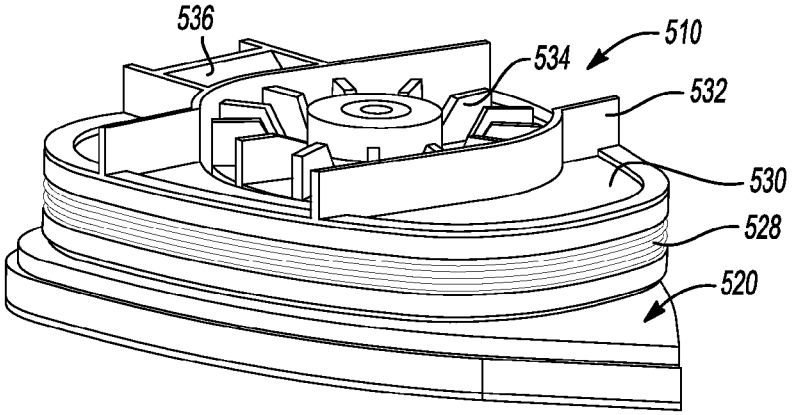
FIG. 31 is a side perspective view of the exemplary sander platen of FIG. 28 and shown cooperating with elastomeric bellows for coupling the sander platen to the tool body.
Figure 32:
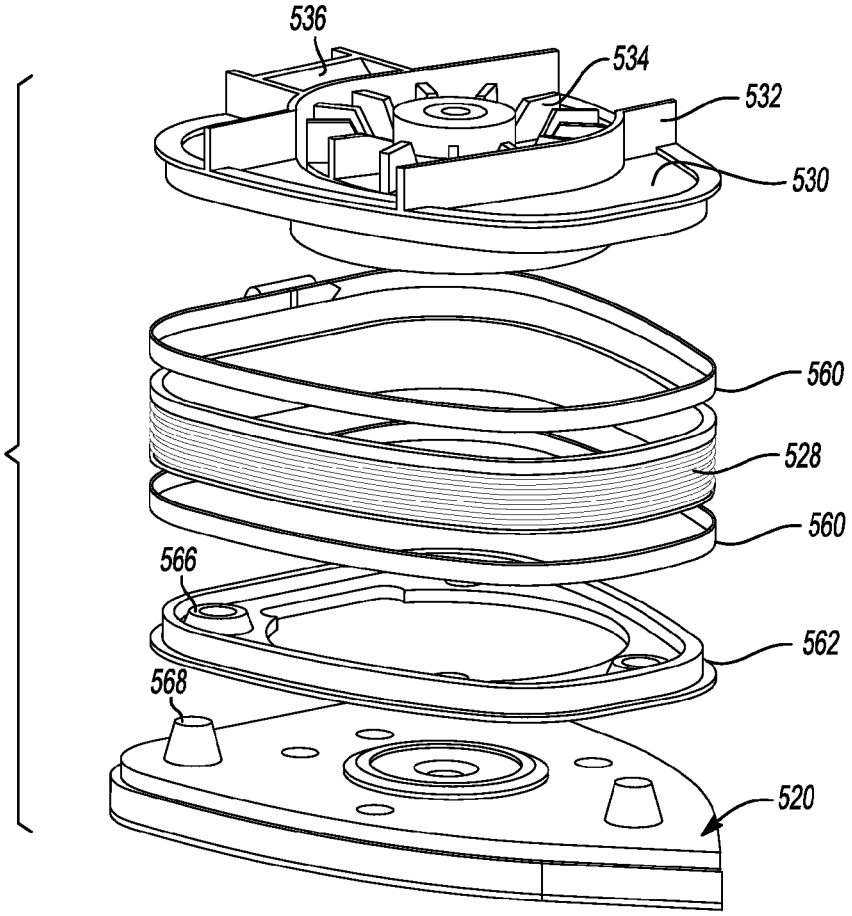
FIG. 32 is a side perspective exploded view of the bellows associated with the sander platen of FIG. 31.
Figure 33:
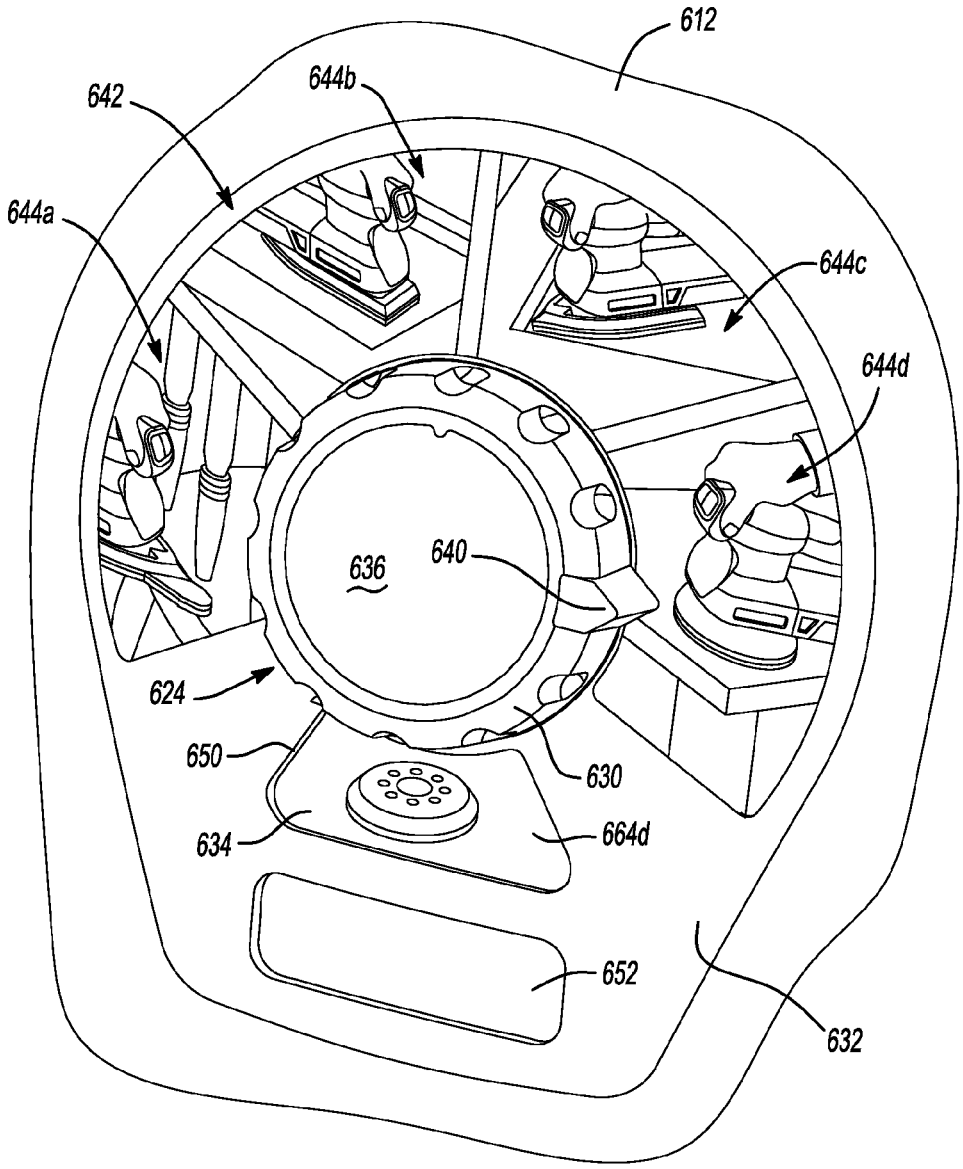
FIG. 33 is a front perspective view of a tool body and mode selector constructed in accordance to additional features of the present teachings.
Figure 34:
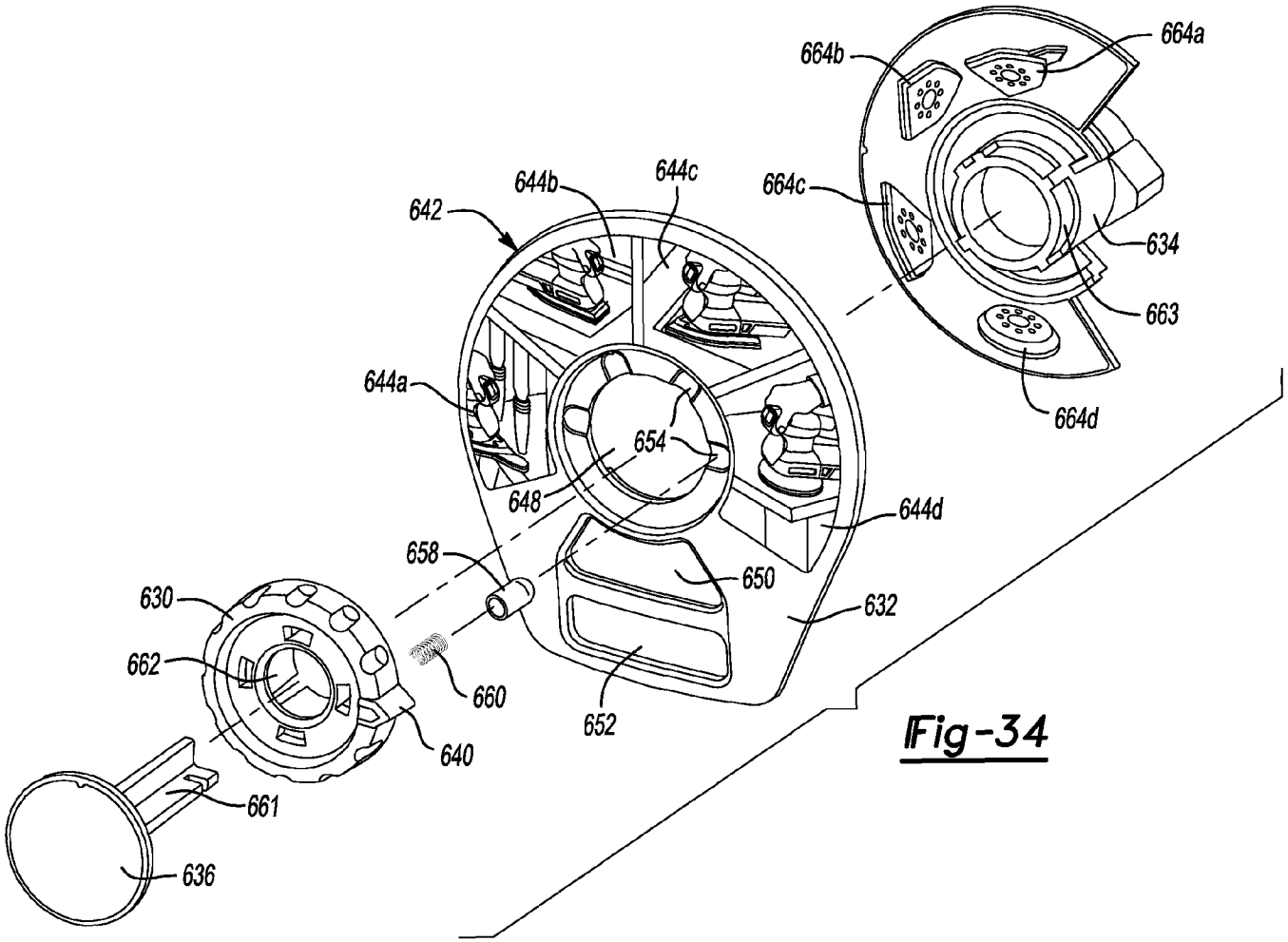
FIG. 34 is a front exploded view of the mode selector of FIG. 33 including a central hub, a knob, a control panel and a wheel.
Figure 35:
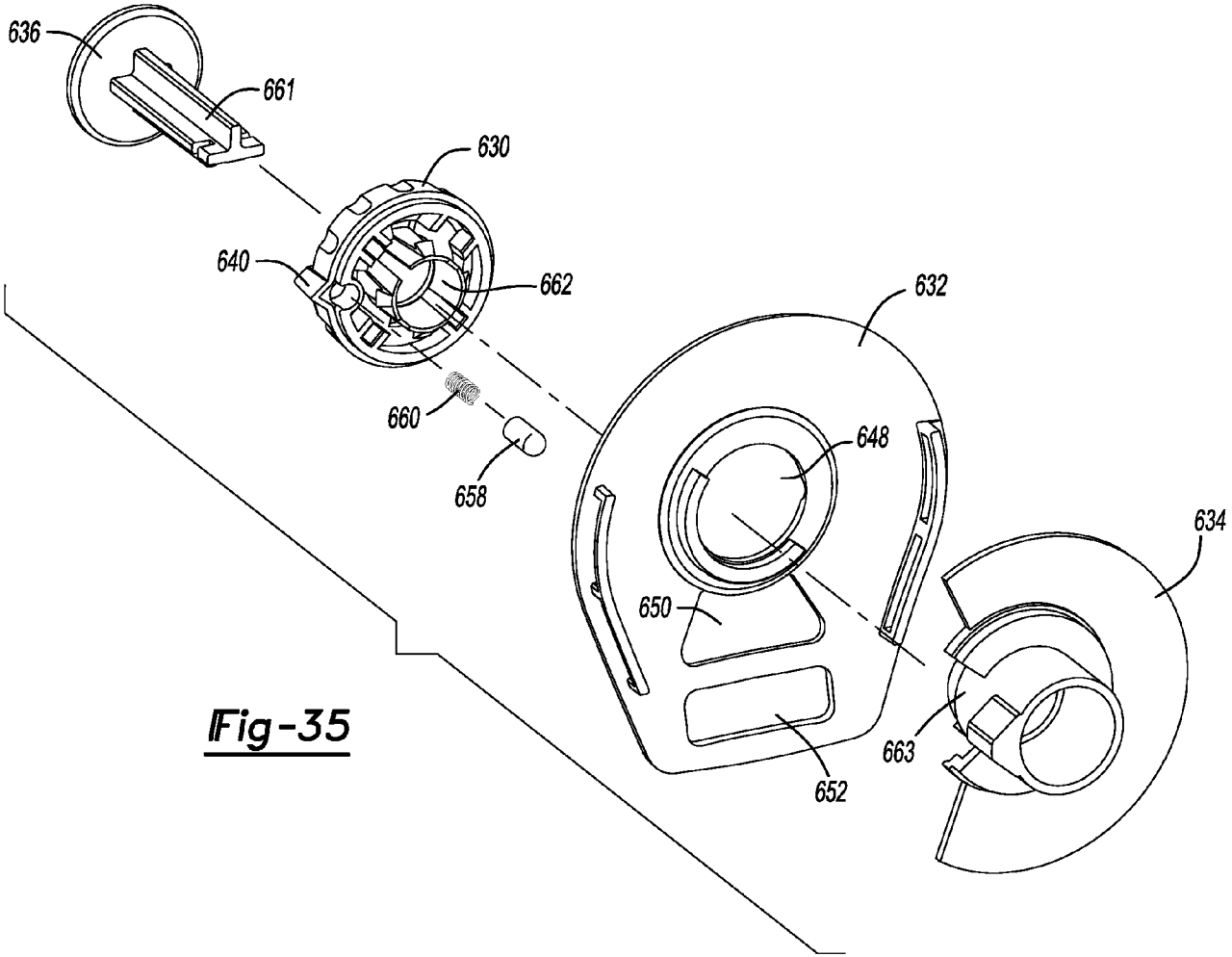
FIG. 35 is a rear perspective view of the mode selector of FIG. 34.

Turning now to FIGS. 28-30, a sander 510 constructed in accordance with additional features of the present teachings is shown. Except as otherwise described, the sander 510 can comprise the features as described herein with respect to other sanders. The sander 510 can include a tool body or housing 512 having a pair of clam shell portions 514 and 516. The sander 510 can further include a drive system 518 that is housed in a cavity defined by the clam shell portions 514 and 516. The tool body 512 and the drive system 518 can be conventional in their construction and operation, and as such, need not be discussed in significant detail. The drive system 518 can selectively couple with a plurality of platens. The platens are shown as a finishing sander platen 520 (FIG. 28), a random orbit sander platen 522 (FIG. 29) and a square finishing sander platen 524 (FIG. 32). The sander 510 provides elastomeric bellows 528 for securing a respective platen 520, 522, 524 to the tool body 512.

As shown in FIG. 29, the elastomeric bellows 528 is shown coupled between a plate 530 having a fan shroud 532 and an exemplary finishing sander platen 520. The fan shroud 532 can generally bound a fan 534 adapted for cooling the motor. The plate 530 can further define a dust chute 536 that is configured to exhaust air through a dust extraction chute (such as dust extraction chute 20). Referring to FIG. 30, the elastomeric bellows 528 can couple between a pair of hose clips 560. The hose clips 560 can couple on opposite ends to the plate 530 and a securing plate 562. In one example, the securing plate 562 can define bosses 566 for selectively receiving pegs 568 formed on the finishing sander platen 520. The elastomeric bellows 528 provides an enclosure for effective dust extraction.

Turning now to FIGS. 33-37, a mode selector 624 constructed in accordance to additional features of the present teachings will be described. The mode selector 624 can be operably disposed on a tool body 612 and can include a movable member 630, a control panel 632, a wheel 634 (FIG. 34) and a central hub 636. The movable member 630 can be in the form of a dial or knob. The movable member 630 can have an indicator 640 formed thereon. The control panel 632 can include a pictorial key 642 that includes graphics in a first zone 644*a*, a second zone 644*b*, a third zone 644*c* and a fourth zone 644*d*. As will become appreciated, the movable member can be configured to rotate, such that the indicator 640 is aligned with a preferred graphic on the pictorial key 642 according to the desired sanding task. The control panel 632 can also define an opening 648, a window 650 and a button passage 652. The control panel 632 can also define recesses 654 adjacent to the opening 648 for selectively receiving a cap 658 that is biased by a spring 660 in a nested position. The biased cap 658 can give a user positive tactile feedback that the movable member 630 is located at the desired position aligned with a respective zone 644*a*-644*d* of the pictorial key 642. In an assembled position, a stem 661 of the central hub 636 locates through an opening 662 formed in the movable member 630, through the opening 648 in the control panel 632 and couples with a hub 663 on the wheel 634. The movable member 630, the central hub 636 and the wheel 634 can then collectively rotate relative to the opening 648 of the control panel 632.

Figure 37:
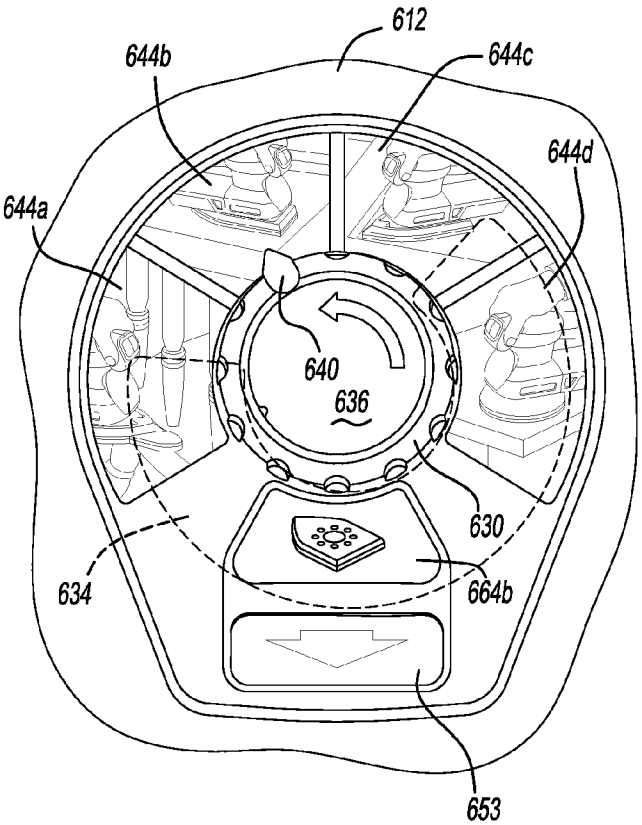
FIG. 37 is a front view of the mode selector illustrating the knob in a second position corresponding to the second image of the wheel being viewable through the window in the control panel.
Figure 36:
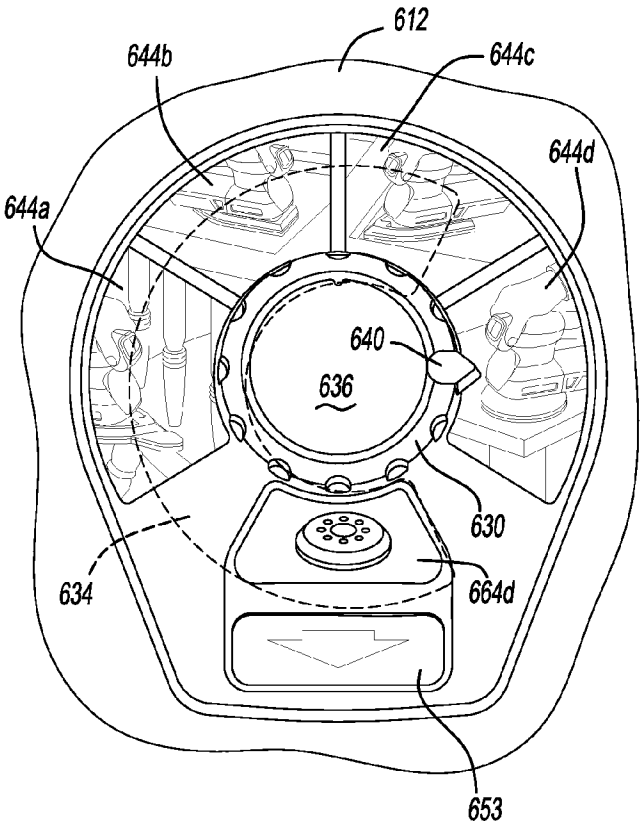
FIG. 36 is a front view of the mode selector shown with the knob located in a fourth position revealing a fourth image of the wheel through a window formed in the control panel.

The wheel 634 can include a first image 664*a*, a second image 664*b*, a third image 664*c*, and a fourth image 664*d*. The wheel 634 is fixed for rotation with the movable member 630, such that one of the first through fourth images 664*a*-664*d* can be viewable through the window 650. The images 664*a*-664*d* correspond with the appropriate graphic 644*a*-644*d* on the pictorial key 642 according to the desired task identified by the user. Explained further, and as illustrated in FIGS. 36-37, a user can rotate the movable member 630 from the location shown in FIG. 36 to the location shown in FIG. 37 when it is desired to change the sanding task. While not expressly described here, rotation of the movable member 630 can cooperate with a speed control switch, such as the speed control switch 188 to correspond with first and second speeds of the motor as described above in relation to FIGS. 20-22.

As illustrated in FIG. 36, the movable member 630 is shown rotated to a location, such that the indicator 640 is pointing at the fourth zone 644*d*. Also shown in FIGS. 36 and 37, a button 653 constructed similar to the button 30 described above is shown extending through the button passage 652. Because the movable member 630 is rotatably fixed with the wheel 634, this position corresponds to the fourth image 664*d* of the wheel 634 to be viewable through the window 650 of the control panel 632. In the example shown in FIG. 37, the user can rotate the movable member, such as in a counterclockwise direction until the indicator 640 is pointing at the second zone 644*b* of the pictorial key 642. In this position, the second image 664*b* is viewable through the window 650 of the control panel 632.

While not specifically shown, those skilled in the art will appreciate that the first image 664*a* of the wheel 634 will be viewable through the window 650 when the indicator 640 is pointing at the first zone 644*a* of the pictorial key 642. Similarly, the third image 644*c* of the wheel 634 will be viewable through the window 650 of the control panel 632 when the indicator 640 is pointing at the third zone 644*c* of the pictorial key 642. According to additional examples, the respective images 664*a*-664*d* can be provided with different colors indicating that some of the selected modes of sanding can include a change in motor speed. It is also appreciated that the mode selector 624 and related features can be configured for operation with any of the sanders described herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A power tool comprising:

a tool body housing at least partly formed by a pair of clam shell housing members, the tool body housing defining a cavity;

a drive system housed in the cavity, the drive system having an output member;

a tool head that is configured to perform work on a work piece, the tool head including a tool head housing and an input member, the input member that is matingly engagable to the output member to drivingly couple the output member of the drive system to the input member of the tool head when the tool head is coupled to the tool body housing; and a connection system having at least one recess and a retainer, the at least one recess being formed in one of the tool head housing and the tool body housing, the retainer being movably coupled to the other one of the tool head housing and the tool body housing, the retainer being received into the at least one recess to fixedly but removably couple the tool head to the tool body housing;

wherein the tool head can be engaged to the tool body housing in at least two pre-defined and distinct orientations and wherein the connection system secures the tool head to the tool body housing in each of the at least two pre-defined and distinct orientations, wherein one of the tool head and the tool body housing includes a mounting hub and wherein the other one of the tool head and the tool body housing includes a recess into which the mounting hub is received, and wherein one or more nubs is formed on the periphery of the mounting hub, the one or more nubs being configured to be received in notches formed in the other one of the tool head and the tool body housing.

2. The power tool of claim 1, wherein the one of the tool head and the tool body housing includes a plurality of legs that interlock to the other one of the tool head and the tool body housing.

3. The power tool of claim 2, wherein the legs are received into pockets formed into the other one of the tool head and the tool body housing.

4. The power tool of claim 2, wherein the legs are formed of a resilient material.

5. The power tool of claim 1, wherein the mounting hub comprises a cylindrical structure.

6. A power tool comprising:

a tool body housing at least partly formed by a pair of clam shell housing members, the tool body housing defining a cavity;

a drive system housed in the cavity, the drive system having an output member;

a tool head that is configured to perform work on a work piece, the tool head including a tool head housing and an input member, the input member that is matingly engagable to the output member to drivingly couple the output member of the drive system to the input member of the tool head when the tool head is coupled to the tool body housing; and a connection system having at least one recess and a retainer, the at least one recess being formed in one of the tool head housing and the tool body housing, the retainer being movably coupled to the other one of the tool head housing and the tool body housing, the retainer being received into the at least one recess to fixedly but removably couple the tool head to the tool body housing;

wherein the tool head can be engaged to the tool body housing in at least two pre-defined and distinct orientations and wherein the connection system secures the tool head to the tool body housing in each of the at least two pre-defined and distinct orientations, and wherein the retainer comprises a member that is formed of wire.

7. A power tool comprising:

a tool body having a tool body housing and a drive system, the drive system comprising a motor and an output member driven by the motor;

a tool head that is configured to perform work on a work piece, the tool head including a tool head housing and an input member that is engagable to the output member such that the input and output members co-rotate about a rotational axis, wherein one of the tool body housing and the tool head housing defines a hub cavity and a plurality of rail cavities, and wherein the other one of the tool body housing and the tool head housing defines a cylindrical hub and a plurality of rails, the cylindrical hub extending longitudinally along the rotational axis and being configured to be received into the hub cavity, the rails being disposed about the cylindrical hub and extending parallel to the rotational axis, the rails being configured to be received into the rail cavities, the input member being matingly engaged to the output member to drivingly couple the drive system to the tool head when the cylindrical hub is received into the hub cavity and the rails are received into the rail cavities; and a connection system having at least one recess and a retainer, the at least one recess being formed in one of the tool head housing and the tool body housing, the retainer being movably coupled to the other one of the tool head housing and the tool body housing, the retainer being received into the at least one recess to fixedly but removably couple the tool head to the tool body.

8. The power tool of claim 7, wherein the rails are integrally and unitarily formed with the cylindrical hub.

9. The power tool of claim 7, wherein the rails number four in quantity.

10. The power tool of claim 7, wherein a quantity of rail cavities is greater than a quantity of rails.

11. The power tool of claim 7, further comprising a connection system having at least one recess and a retainer, the at least one recess being formed in one of the tool head housing and the tool body housing, the retainer being movably coupled to the other one of the tool head housing and the tool body housing, the retainer being received into the at least one recess to fixedly but removably couple the tool head to the tool body.

12. The power tool of claim 11, wherein the retainer comprises a member that is formed of wire.

13. The power tool of claim 7, wherein the rail cavities are disposed symmetrically about the hub cavity.

14. The power tool of claim 7, wherein the rail cavities intersect the hub cavity.

15. A power tool comprising:

a tool body having a tool body housing and a drive system, the tool body housing defining a cavity and having a first handle with a portion that is configured to be gripped by a hand of a user of the power tool, the drive system comprising a motor and an output member driven by the motor, the output member being rotatable about a rotational axis, the first handle having a first longitudinal axis that is aligned to a predetermined angle relative to the rotational axis, the predetermined angle being sized so that the longitudinal axis is closer to being parallel to the rotational axis than being perpendicular to the rotational axis; and a tool head that is configured to perform work on a work piece, the tool head including a tool head housing and an input member, wherein one of the tool body and the tool head housing defines a mount, wherein the other one of the tool body and the tool head housing defines a mating mount with a mount aperture that receives the mount, the input member being matingly engagable to the output member to drivingly couple the drive system to the tool head when the mount is inserted into the mount aperture; and a connection system having at least one recess and a retainer, the at least one recess being formed in one of the mount and the mating mount, the retainer being movably coupled to the other one of the mount and the mating mount, the retainer being received into the at least one recess to fixedly but removably couple the tool head to the tool body.

16. The power tool of claim 15, wherein the tool body housing further includes a second handle having a second longitudinal axis that is aligned perpendicular to the rotational axis.

17. The power tool of claim 15, wherein the retainer comprises a member that is formed of wire.

18. The power tool of claim 15, wherein the one of the tool body and the tool housing further comprises a plurality of rails and wherein the other one of the tool body and the tool housing defines a plurality of rail cavities that receive the rails when the mount is inserted into the mount aperture.

19. The power tool of claim 18, wherein the tool head can be engaged to the tool body housing in at least two predefined and distinct orientations and wherein the connection system secures the tool head to the tool body housing in each of the at least two pre-defined and distinct orientations.

20. A power tool system comprising:

a tool body having a body housing, a motor, an intermediate output member and a coupler, the body housing defining a tool head aperture and a pocket that is spaced apart from the tool head aperture, the motor being received in the body housing and driving the intermediate output member for rotation about an axis, the coupler comprising a wire member and a push button, the wire member being housed in the body housing and having a pair of opposite engagement arms that extend into the tool head aperture, the push button being coupled to the wire member and slidable between a first position and a second position;

a tool head having a head housing, an intermediate input member, an output member, the head housing including an attachment hub and a tongue that is spaced apart from and fixedly coupled to the attachment hub, the attachment hub having a generally cylindrical projection with at least one recess formed thereon, the attachment hub being received into the tool head aperture , the tongue being received in the pocket, both the attachment hub and the tongue being non-rotatably engaged directly to the body housing, the engagement arms being received into the at least one recess to inhibit movement of the head housing along the axis in a direction away from the body housing, the intermediate input member being coupled to the intermediate output member for rotation therewith, the output member being drivingly coupled to the intermediate input member;

wherein the wire member biases the push button into the first position and wherein movement of the push button into the second position spreads the engagement arms apart from one another to permit the head housing to be withdrawn from the body housing along the axis.

21. The power tool of claim 20, wherein one of the tool head and the body housing includes a plurality of legs that interlock to the other one of the tool head and the body housing.

22. The power tool of claim 21, wherein the legs are received into pockets formed into the other one of the tool head and the body housing.

23. The power tool of claim 21, wherein the legs are formed of a resilient material.

24. The power tool of claim 20, wherein one of the body housing and the head housing further comprises a plurality of rails and wherein the other one of the body housing and the head housing defines a plurality of rail cavities that receive the rails when the attachment hub is inserted into the tool head aperture.

25. The power tool of claim 24, wherein the tool head can be engaged to the body housing in at least two pre-defined and distinct orientations and wherein the coupler secures the tool head to the body housing in each of the at least two pre-defined and distinct orientations.

26. The power tool of claim 20, wherein one or more nubs is formed on the periphery of one of the attachment hub and the tool head aperture, the one or more nubs being configured to be received in notches formed in the other one of the attachment hub and the tool head aperture.

* * * * *